US010315411B2

(12) United States Patent
Boas et al.

(10) Patent No.: US 10,315,411 B2
(45) Date of Patent: Jun. 11, 2019

(54) DEVICE FOR PRINTING CANS, A PROCESS FOR PRINTING CANS, A PRINTED CAN AND A TRANSFER BLANKET

(71) Applicant: Rexam Beverage Can South America S.A., Barra da Tijuca, Rio de Janeiro (BR)

(72) Inventors: Joao Vilas Boas, Rio de Janeiro (BR); Jeffrey Lewis, Trussville, AL (US)

(73) Assignee: BALL BEVERAGE CAN SOUTH AMERICA S.A., Rio de Janeiro (BR)

( * ) Notice: Subject to any disclaimer, the term of this patent is extended or adjusted under 35 U.S.C. 154(b) by 0 days.

(21) Appl. No.: 15/399,192

(22) Filed: Jan. 5, 2017

(65) Prior Publication Data

US 2017/0113452 A1 Apr. 27, 2017

Related U.S. Application Data

(63) Continuation of application No. 14/412,585, filed as application No. PCT/IB2013/051746 on Mar. 5, 2013, now Pat. No. 9,573,358.

(30) Foreign Application Priority Data

Jul. 2, 2012 (BR) ..... 1020120163934

(51) Int. Cl.
*B41F 17/28* (2006.01)
*B41C 1/05* (2006.01)
(Continued)

(52) U.S. Cl.
CPC ..... *B41F 17/28* (2013.01); *B41C 1/05* (2013.01); *B41F 11/00* (2013.01); *B41F 17/22* (2013.01);
(Continued)

(58) Field of Classification Search
CPC ..... B41F 7/02; B41F 7/08; B41F 7/10; B41F 7/14; B41F 11/00; B41F 17/006;
(Continued)

(56) References Cited

U.S. PATENT DOCUMENTS 3,252,410 A * 5/1966 Stephenson ..... B41F 19/02 101/217
3,286,302 A 11/1966 Doering
(Continued)

FOREIGN PATENT DOCUMENTS

CA 2097619 5/1992
CN 101808825 8/2010
(Continued)

OTHER PUBLICATIONS

European Patent Office acting as International Searching Authority, International Search Report dated Aug. 3, 2016 in PCT/IB2015/002071.

(Continued)

*Primary Examiner* — Matthew G Marini
*Assistant Examiner* — Marissa Ferguson Samreth
(74) *Attorney, Agent, or Firm* — Greer, Burns & Crain, Ltd.

(57) ABSTRACT

A device 1 for imprinting cans 8 comprises a plurality of ink cartridges 2*a*-2*f* that supply ink to a plurality of printing plates 3*a*-3*f*; the printing plates 2*a*-2*f* communicate with transfer blankets 5*a*-5*l* fixed to drum 6, the transfer blankets 5*a*-5*l* move ink from the printing plates 2*a*-2*f* and apply it to cans 8; each transfer blanket 2*a*-2*f* includes a different art in low relief (FIG. 15) which produces an image on cans 8 in addition to the image produced by printing plates 2*a*-2*f*; the device 1 is preferably a rotary dry offset printer. A method of printing cans comprising forming a relief image in a transfer blanket with a laser is also disclosed.

20 Claims, 11 Drawing Sheets

(51) Int. Cl.

| | |
|---|---|
| ***B41M 1/28*** | (2006.01) |
| ***B41M 1/40*** | (2006.01) |
| ***B41F 17/22*** | (2006.01) |
| ***B65D 1/12*** | (2006.01) |
| ***B41F 11/00*** | (2006.01) |
| *B65D 17/28* | (2006.01) |
| *B41N 10/02* | (2006.01) |

(52) U.S. Cl.
CPC ..... *B41M 1/28* (2013.01); *B41M 1/40* (2013.01); *B65D 1/12* (2013.01); *B41N 10/02* (2013.01); *B41N 2210/02* (2013.01); *B65D 17/28* (2018.01)

(58) Field of Classification Search
CPC ..... B41F 17/14; B41F 17/18; B41F 17/20; B41F 17/22; B41F 17/28; B41F 31/18; B41F 33/10; B41C 1/05; B41M 1/00; B41M 1/28; B41M 1/40; B41M 3/14; B26D 1/12; B26D 17/16; B41N 10/02; B41N 2210/02
See application file for complete search history.

(56) References Cited

U.S. PATENT DOCUMENTS 3,752,073 A 8/1973 Lorber
3,766,851 A 10/1973 Sirvet et al.
3,960,073 A 6/1976 Rush
3,991,673 A 11/1976 Coale et al.
4,048,917 A 9/1977 Skrypek et al.
4,132,826 A 1/1979 Dessauer et al.
4,142,462 A 3/1979 Gilore
4,384,518 A 5/1983 Albin
4,395,946 A 8/1983 Price
4,471,011 A 9/1984 Spöring
4,479,429 A 10/1984 Haryu
4,519,310 A 5/1985 Shimizu et al.
4,589,339 A 5/1986 Fischer
4,741,266 A 5/1988 Stirbis et al.
4,884,504 A 12/1989 Sillars
4,889,560 A 12/1989 Jaeger et al.
4,898,752 A 2/1990 Cavagna et al.
4,903,599 A 2/1990 Kulber et al.
5,010,814 A 4/1991 Shishikura
5,049,432 A 9/1991 Ooms et al.
5,181,471 A 1/1993 Sillars
5,213,043 A 5/1993 Reimers et al.
5,282,306 A 2/1994 Katsuhiro
5,337,659 A * 8/1994 Whelan ..... B41F 17/007 101/217
5,339,731 A 8/1994 Howard et al.
5,351,617 A 8/1994 Williams et al.
5,353,703 A 10/1994 Rieker
5,385,092 A 1/1995 Lewis et al.
5,469,787 A 11/1995 Turner et al.
5,502,476 A 3/1996 Neal et al.
5,591,255 A 1/1997 Small et al.
5,713,288 A 2/1998 Frazzitta
5,771,798 A 6/1998 Shriver
5,806,427 A 9/1998 Niemiro et al.
5,908,505 A 6/1999 Bargenquest et al.
5,919,839 A 7/1999 Titterington et al.
5,970,865 A 10/1999 Horth et al.
5,974,974 A 11/1999 Agnew et al.
6,037,101 A 3/2000 Telser et al.
6,058,839 A 5/2000 Frazzitta
6,079,326 A 6/2000 Strutz et al.
6,139,779 A 10/2000 Small et al.
6,174,937 B1 1/2001 Banning et al.
6,196,675 B1 3/2001 Deily et al.
6,238,837 B1 5/2001 Fan
6,309,453 B1 10/2001 Banning et al.
6,312,872 B1 11/2001 Murphy
6,395,123 B1 5/2002 Fromson et al.
6,494,950 B1 12/2002 Fujita et al.
6,543,350 B2 4/2003 Gilliam et al.
6,550,389 B1 4/2003 Goto et al.
6,553,907 B2 4/2003 Richards
6,584,895 B1 7/2003 Strauch et al.
6,594,927 B2 7/2003 Witkowski
6,640,713 B2 11/2003 Landsman
6,651,559 B2 11/2003 Haraux et al.
6,779,445 B2 8/2004 Schaede
6,779,455 B2 8/2004 Figov et al.
6,827,019 B1 12/2004 Hieronymus et al.
6,899,998 B2 5/2005 Figov
6,920,822 B2 7/2005 Finan
6,989,226 B2 1/2006 Araki et al.
7,309,563 B2 12/2007 Paul et al.
7,399,526 B2 7/2008 Dalmais et al.
7,464,642 B2 12/2008 Schaede
7,691,549 B1 4/2010 Glasser
7,810,922 B2 10/2010 Gervasi et al.
7,997,199 B2 8/2011 Watanabe et al.
8,034,207 B2 10/2011 Hunahata
8,409,698 B2 4/2013 Byers et al.
8,544,385 B2 10/2013 Schuler-Cossette et al.
9,409,433 B2 8/2016 Carreras
9,475,276 B2 10/2016 Fleischer et al.
9,555,616 B2 1/2017 Carreras et al.
2002/0083855 A1 4/2002 Samworth
2002/0178945 A1 12/2002 Richards
2002/0189471 A1 12/2002 Juffinger et al.
2003/0015105 A1 1/2003 Dewig
2003/0056410 A1 3/2003 Witkowski
2003/0089261 A1 5/2003 Landsman
2003/0101885 A1 6/2003 Jordan
2003/0150346 A1 8/2003 Haraux et al.
2004/0011234 A1 1/2004 Figov et al.
2004/0126682 A1 7/2004 Dreher et al.
2004/0173110 A1* 9/2004 Roesch ..... B41F 17/22 101/136
2004/0191693 A1 9/2004 Takamiya
2005/0098051 A1 5/2005 Flint et al.
2006/0019196 A1 1/2006 Miyoshi
2006/0121389 A1 6/2006 Anzures et al.
2007/0084368 A1 4/2007 Vest et al.
2009/0186308 A1 7/2009 Rudolph
2009/0303307 A1 12/2009 Yasumatsu
2010/0031834 A1* 2/2010 Morgavi ..... B41J 2/0057 101/38.1
2010/0229737 A1* 9/2010 Ouchi ..... B21D 51/26 101/4
2010/0295885 A1 11/2010 LaCaze
2010/0319555 A1 12/2010 Hashimoto et al.
2011/0079158 A1 4/2011 Recchia et al.
2011/0104615 A1 5/2011 Sievers
2011/0126760 A1 6/2011 Daems et al.
2011/0162542 A1 7/2011 Nakamura et al.
2011/0255134 A1 10/2011 Shigeta et al.
2011/0283905 A1 11/2011 Sakata
2012/0048135 A1 3/2012 Burberry et al.
2012/0103216 A1 5/2012 Knisel et al.
2012/0204746 A1 8/2012 Fullgraf
2012/0238675 A1 9/2012 Kataura et al.
2012/0272846 A1* 11/2012 Fleischer ..... B41F 17/22 101/38.1
2012/0274695 A1 11/2012 LaCaze et al.
2012/0315412 A1 12/2012 Clayton et al.
2013/0019566 A1 1/2013 Schach
2013/0075675 A1 3/2013 Krutak et al.
2013/0105743 A1 5/2013 Owen et al.
2013/0176358 A1 7/2013 Yamada et al.
2013/0228086 A1 9/2013 Baldwin et al.
2013/0231242 A1 9/2013 Clayton et al.
2013/0242276 A1 9/2013 Schadebrodt et al.
2013/0340885 A1 12/2013 Clayton et al.
2014/0039091 A1 2/2014 Owen et al.
2014/0072442 A1 3/2014 Bowman et al.
2014/0187668 A1 7/2014 Owen et al.
2014/0210201 A1 7/2014 Owen et al.
2014/0212654 A1 7/2014 Clayton et al.

(56) References Cited

U.S. PATENT DOCUMENTS

| | | | | |
|---|---|---|---|---|
| 2014/0272161 | A1 | 9/2014 | Clayton et al. | |
| 2014/0299009 | A1* | 10/2014 | Miller | B41F 17/005 101/36 |
| 2015/0174891 | A1 | 6/2015 | Boas et al. | |
| 2015/0183211 | A1 | 7/2015 | Petti et al. | |
| 2015/0290923 | A1 | 10/2015 | Treloar | |
| 2016/0001546 | A1 | 1/2016 | Hughes et al. | |
| 2016/0129687 | A1 | 5/2016 | Boas et al. | |
| 2016/0347048 | A1 | 12/2016 | Carreras | |
| 2017/0013452 | A1 | 4/2017 | Boas et al. | |
| 2018/0009216 | A1 | 1/2018 | Egerton et al. | |

FOREIGN PATENT DOCUMENTS

| | | | |
|---|---|---|---|
| CN | 102143846 | | 8/2011 |
| CN | 103109233 | | 5/2013 |
| DE | 198 07 924 | A1 | 8/1998 |
| DE | 102 25 198 | A1 | 1/2004 |
| DE | 102006025897 | | 1/2007 |
| EP | 202928 | | 11/1986 |
| EP | 545862 | | 6/1993 |
| EP | 0641648 | A1 | 3/1995 |
| EP | 0717320 | | 6/1996 |
| EP | 1262316 | | 12/2002 |
| EP | 2153991 | | 2/2010 |
| EP | 2 196 314 | A1 | 6/2010 |
| EP | 2317387 | | 5/2011 |
| EP | 2384890 | | 11/2011 |
| EP | 2842747 | A1 | 3/2015 |
| GB | 1298205 | | 11/1972 |
| GB | 2097331 | A | 11/1982 |
| GB | 2504370 | A | 1/2014 |
| GB | 2512678 | | 10/2014 |
| JP | 1997039366 | A | 2/1997 |
| JP | 2000-258899 | | 9/2000 |
| JP | 2001/030612 | | 2/2001 |
| JP | 2007/076209 | | 3/2007 |
| JP | 2009-126038 | | 11/2009 |
| KR | 10-2006-0004679 | | 1/2006 |
| WO | 1990/02044 | | 3/1990 |
| WO | 92/09435 | | 6/1992 |
| WO | 94/07693 | | 4/1994 |
| WO | 98/17474 | | 4/1998 |
| WO | 98/41966 | | 9/1998 |
| WO | 00/27644 | | 5/2000 |
| WO | 2004069539 | | 8/2004 |
| WO | 2005023545 | A1 | 3/2005 |
| WO | 2005047011 | | 5/2005 |
| WO | 2006/048022 | A2 | 5/2006 |
| WO | 2009/090389 | | 7/2009 |
| WO | 2012148576 | | 11/2012 |
| WO | 2013/028804 | | 2/2013 |
| WO | 2013/115800 | | 8/2013 |
| WO | 2013113616 | | 8/2013 |
| WO | 2013/155423 | | 10/2013 |
| WO | 2014/008544 | | 1/2014 |
| WO | 2014006517 | A1 | 1/2014 |
| WO | 2014/096088 | | 6/2014 |
| WO | 2014108489 | | 7/2014 |
| WO | 2014128200 | A2 | 8/2014 |
| WO | 2014/144853 | | 9/2014 |
| WO | 2015101828 | A1 | 7/2015 |
| WO | 2016/183452 | | 11/2016 |
| WO | 2018013465 | A1 | 1/2018 |

OTHER PUBLICATIONS

European Patent Office, International Search Report and Written Opinion for Rexam Beverage Can South America S.A. PCT/IB2013/051746, dated Sep. 13, 2013.

European Patent Office acting as International Searching Authority, International Search Report and Written Opinion dated Apr. 24, 2015 in PCT/IB2014/002904.

Third Party Observations submitted on Oct. 21, 2014 in PCT/IB2013/0851746.

United Kingdom Intellectual Property Office, Examination Report dated May 14, 2013 in GB Application No. GB1303937.5.

United Kingdom Intellectual Preoperty Office, Second Examination Report dated Aug. 13, 2014 in GB Application No. GB1303937.5.

United Kingdom Intellectual Property Office, Third Examination Report dated Jul. 13, 2015 in GB Application No. GB1303937.5.

Third Party Observations submitted on Mar. 10, 2014 in UKIPO Application No. GB1303937.5.

Third Party Observations submitted on Jul. 4, 2014 in UKIPO Application No. GB1303937.5.

Third Party Observations submitted on Feb. 12, 2015 in UKIPO Application No. GB1303937.5.

United Kingdom Intellectual Property Office, Search Report under Section 17 for Rexam Beverage Can South America S.A. United Kingdom Patent Application No. 1303937.5, search performed May 13, 2013.

"Blanket for Offset Printing," Offset printing technology, 2016, 4 pages [retrieved from: www.offsetprintingtechnology.com.sub-categories/blanket-for-offset-printing/].

Bowell et al., "Advancing Flexography: The Technical Path Forward," DuPont, 2011, retrieved from www2.dupont.com/packaging_graphics/en_us/assets/downloads/pdf/advflexo_brochure.pdf, 12 pages.

"Chemical Milling," Wikipedia, Feb. 13, 2015, retrieved from http://en.wikipedia.org/wiki/chemical_milling, 6 pages.

"Cyrel® DSP High Performance Plate," DuPont, 2016, 2 pages [retrieved online from: www.dupont.com/products-and-services/printing-package-printing/flexographic-platemaking-systems/brands/cyrel/products/sub-products/cyrel-dsp.html].

Corrected Notice of Allowance for U.S. Appl. No. 14/686,517, dated Sep. 28, 2016 6 pages.

"Dry Offset Printing," Encyclopedia Britannica, 2016, 2 pages [retrieved online from: www.britannica.com/technology/dry-offset].

"DuPont™ Cyrel®: CyrelTM Digital flex plate Imagers (CDI)" DuPont, 2009, retrieved from http://www2.dupont.com/packaging_graphics/en_gb/assets/downloads/pdf/CDI_family_english.pdf, 8 pages.

"DuPont™ Cyrel® DPR: Robust Digital Plate for Highest Quality Printing," DuPont 2010, retrieved from http://www2.dupont.com/packaging_graphics/en_us/assets/downloads/pdf/DP_Cyrel_DS_DPR_us_low.pdf., 2 pages.

"DuPont™ Cyrel® NOWS: Rugged, High-Performance Analog Plate," DuPont, 2007, retrieved from http:www2.dupont.com/packaging_graphics/en_us/assests/downloads/pdf/Cyrel_NOWS.pdf, 2 pages.

"EPDM Rubber," Wikipedia, Oct. 24, 2014, retrieved from http://enwikipedia.org/wiki/EPDM_rubber, 3 pages.

Extended Search Report for European Patent Application No. 14810948.1, dated Apr. 11, 2017 10 pages.

"Flexographic Ink," Wikipedia, Sep. 18, 2014, retrieved from http://en.wikipedia.org/wiki/flexographic_ink, 2 pages.

"Flexography," Wikipedia, Dec. 15, 2014, retrieved from http://en.wikipedia.org/wiki/flexorgraphic, 6 pages.

International Preliminary Report on Patentability for International (PCT) Patent Application No. PCT/US2014/041713, dated Dec. 15, 2015 6 pages.

International Preliminary Report on Patentability for International (PCT) Patent Application No. PCT/US2016/027576, dated Jul. 22, 2016 6 pages.

International Search Report and Written Opinion for International (PCT) Patent Application No. PCT/US16/27576, dated Jul. 22, 2016 5 pages International Search Report and Written Opinion for International (PCT) Patent Application No. PCT/US14/41713, dated Oct. 10, 2014 8 pages "Laser Engraving," Wikipedia, Jan. 16, 2015, retrieved from http://en.wikipedia.org/wiki/laser_engraving, 10 pages.

"Luminous Paint," Wikipedia, Jul. 7, 2014, retrieved from http://en.wikipedia.org/wiki/luminous_paint, 4 pages.

Mine, "How Offset Printing Works," retrieved on Feb. 9, 2015 from www.howstuffworks.com/offset-printing.htm/printable, 5 pages.

Notice of Allowance for U.S. Appl. No. 14/301,018, dated Apr. 6, 2016 10 pages.

(56) References Cited

OTHER PUBLICATIONS

Notice of Allowance for U.S. Appl. No. 15/231,128, dated Jan. 5, 2018 8 pages.
Notice of Allowance for U.S. Appl. No. 14/686,517, dated Sep. 13, 2016 9 pages.
Office Action and Translation for corresponding Japanese Patent Application No. 2015519388 dated Mar. 6, 2018 (4 pages).
Official Action for European Patent Application No. 13 721 561.2-1014 dated Apr. 18, 2018 (6 pages).
Official Action for U.S. Appl. No. 14/301,018, dated Aug. 14, 2015 10 pages.
Official Action for U.S. Appl. No. 14/005,873, dated Aug. 26, 2015, 27 pages.
Official Action for U.S. Appl. No. 14/301,018, dated Dec. 15, 2015 8 pages.
Official Action for U.S. Appl. No. 14/686,517, dated Jan. 15, 2016 8 pages.
Official Action for U.S. Appl. No. 15/231,128, dated Jul. 13, 2017 8 pages.
Official Action for U.S. Appl. No. 14/686,517, dated Jul. 6, 2016 9 pages.
Official Action for U.S. Appl. No. 14/301,018, dated May 13, 2015 5 pages.
Official Action for U.S. Appl. No. 14/686,517, dated Oct. 15, 2015 5 pages Restriction Requirement.
"Offset Lithography," PrintWiki, retrieved Feb. 9, 2015 from http://printwiki.org/offset_lithography, 8 pages.
"Offset Printing," Wikipedia, Dec. 11, 2014, retrieved from http://en.wikipedia.org/wiki/offset_printing, 12 pages.
"Offset Printing," Offset Printing Technology, 2016, 4 pages [retrieved online from: www.offsetprintingtechnology.com].
"Offset Printing," BusinessDictionary.com, 2015, 2 pages [retrieved online from: www.businessdictionary.com/definition/offset-printing.html].
"Offset Printing/Dry Offset," Buse Printing & Packaging, 2016, 1 page [retrieved online from: buseprinting.com/offset_printing.html].
"Plate," PrintWiki, retrieved Feb. 9, 2015 from http://printwiki.org/Plate, 6 pages.
"Printmaking," Wikipedia, Feb. 12, 2015, retrieved from http://en.wikipedia.org/wiki/printmaking, 14 pages.
Third Party Observations for European Patent Application No. 14810948.1, dated Jan. 29, 2018 5 pages.
Third Party Observations for European Patent Application No. 14810948.1, dated Dec. 21, 2016 5 pages.
"What is Offset Printing (Offset Lithography)?" TechTarget, 2016, 13 pages [retrieved online from: whatis.techtarget.com/definition/offset-printing-offset-lithography].

* cited by examiner

DEVICE FOR PRINTING CANS, A PROCESS FOR PRINTING CANS, A PRINTED CAN AND A TRANSFER BLANKET

CROSS-REFERENCE TO RELATED APPLICATIONS

This Application is a continuation of application Ser. No. 14/412,585, which was filed on Jan. 2, 2015, and is now U.S. Pat. No. 9,573,358, which was a U.S. National Stage filing under 35 U.S.C. § 371 of International Application No. PCT/IB2013/051746, having an international filing date of Mar. 5, 2013, also claiming priority under 35 U.S.C. § 119 from Brazilian Patent Application No. BR 1020120163934 having a filing date of Jul. 2, 2012, all of which are incorporated by reference as if fully set forth herein.

TECHNICAL FIELD

The present invention relates to a device for imprinting cans, especially aluminum cans having more than one finished art on its surface. The invention also relates to a process for imprinting the respective can, as well as to the can obtained by this imprinting process.

BACKGROUND OF THE INVENTION

Currently, packaging cans of drinks or liquids have impressions on their outer surface, mainly due to the fact that the contents of the can have to be communicated to the consumer because there is a market need related to the printing in different colors.

The most common printing type performed on the cans is the dry rotary offset-type which is made by a specific printer for this purpose.

This type of printing enables one to apply a plurality of colors onto the cans that are metallic, preferably, made of either aluminum or steel. Such an imprinting is carried out on cans during their manufacturing process, which consists of a sequence of cutting, mechanical shaping, the imprinting itself and subsequent shaping, until the can reaches its final desired shape to receive the liquid contents and corresponding closure.

Of course, the steps to which the cans are submitted in the manufacture process will not be described in the present specification, since the object of the invention in question is directed to the imprinting itself.

In any event, an imprinting device or a printer, as it is usually known, can be seen in FIG. 1.

The device 1 of FIG. 1 is composed of a plurality of components, wherein six ink cartridge 2*a*-2*f* are present, which are supplied with ink that will be applied onto the can surface with the purpose of imparting a determined color to said surface.

Thus, it is necessary for the imprinting device to be provided with an ink cartridge 2*a*-2*f* for each of the colors that one wishes to apply onto the cans, i.e., if a can is to be printed with three colors, namely black, red and white, three of the six ink-cartridge 2*a*-2*f* should be supplied with the necessary dye. It should be noted that in this type of equipment there is a limitation of the number of colors to be applied to the can imprinting that is linked to the number of ink-cartridge available. In other words, if there is interest in imprinting, for instance, ten different colors onto the can, it is necessary that the imprinting device should have at least ten ink-holders 2*a*-2*f*.

The ink-holders 2*a*-2*h* in turn, supply ink to transferring or printing plates 3*a*-3*f* which have the finished art to be imprinted onto the can. This finished art may be a text, a figure or any type of graphic which one wishes to make on a can, wherein it is of the utmost importance to position the printing plate correctly, so that it receives the ink from the ink-cartridge. For this purpose, the printing plate, for example, 3*a*, which is generally produced from a magnetic material, has a precise alignment on the plate cylinder 4*a*.

This alignment is achieved from the guide-bores existing in the printing plate (not shown in the Figure), which are aligned to guide-pins on the plate cylinder 4; which in turn is formed by a substantially cylindrical body, on which the printing plate involves its outer surface in an aligned and well-fixed manner. This is possible because the outer surface of the plate cylinder is formed by magnets that attract said printing plate 3*a* and keep it in the desired position.

It is also important to point out that the finished art present on the printing plate 4*a* is in relief, so that it transfers the ink supplied by the ink cartridge 2*a* to a transfer blanket 5*a*. This transfer blanket 5*a* is an ink transferring means between the printing plate 3*a* and the can to be imprinted.

Thus, the relief on the printing plate 3*a* that has the finished art comes into contact with the transfer blankets; thus transferring only the ink that is present thereon to said transfer blanket 5*a*. This is carried out by rotation of the printing plate 3; which transfers the ink present in relief to the transfer blankets; which is fixed on the transfer blanket drum 6, which is a device with rotation synchronized with (i) the cans to be imprinted, (ii) the positioning of the transfer blankets 5*a*-5*l* that are on the surface of such a transfer blanket drum 6, and (iii) the printing plates 3*a*-3*f*.

Indeed, if there is synchronization between these elements, it is possible that the cans will be imprinted in a quite precise manner. This is of the utmost importance for can imprinting, since there is no overlapping of the imprint on the can when it receives more than one finished art on its surface. In other words, the finished art of a first printing plate 3*a* will transfer ink only to a determined area of the transfer blankets 5*a*-5*l*, whereby a second printing plate 3*b*-3*f* will transfer ink present only on its surface to another area that did not receive ink from the first printing plate 3; and so on. Of course, this depends on the number of imprinting colors on the cans.

Thus, there is the possibility of imprinting the whole can surface, without occurring ink overlapping, which would impair the imprint on the can in this type of rotary dry offset imprinting, since such overlapping would cause an imprinting defect, for example stain.

In this regard, it should be stressed that there is transfer of more than one finished art with a different color to one or more than one transfer blanket 5*a*-5*l* present on the transfer blanket drum 6 from the respective printing plates 3*a*-3*f* that are in communication with the respective ink-cartridges. Hence, upon continuous rotation of the transfer blanket drum, the latter comes into contact with the cans to be imprinted from the transfer blankets positioned there.

It is reiterated that each of the transfer blankets 5*a*-5*l* can receive, on its surface, a plurality of different colors coming from more than one printing plate 3*a*-3*f* but the transfer blankets 5*a*-5*l* do not have any over-lapping of finished art with different colors.

The cans to be imprinted may even be colorful, but when they are examined in detail one can see that with this type of imprinting there is no color overlapping. Despite the proximity of the different colors that are on the can surface, there will always be a small space between the imprinting of different colors.

It is also important to note that, when one wishes to change the finished art present on the cans that are being imprinted, it is necessary to interrupt the production, that is, the imprinting device 1 should necessarily be stopped, and so it cannot make the imprint the cans any longer. Such stoppage is necessary, because there may be the need to change the printing color of the can, or to change a can for a different product. For example, when one is carrying out a type of can imprinting and wishes to change the finished art present on the cans, it is necessary to interrupt the imprinting process. In short, with the existing process and equipment, it is only possible to achieve one type of finished art printed on the can with the same imprinting device. If it is necessary to change the imprint on the can, the production will necessarily have to be interrupted, which for economical reason should be minimized as much as possible.

This can be easily observed through the order or magnitude of can imprinting, which is very significant. With the present-day pieces of equipment, one can imprint approximately 2.5 million cans in a single day.

Thus, at present there are a number of studies with a view to minimize, as much as possible, the stoppages of this type of equipment, so that the production will not be interrupted. It is noted that these stoppages are, as a rule, compulsory, because the same production line is intended for cans with the most varied finished arts, as for example, a can intended for beer or soft drinks.

In turn, in the face of the significant amount of production of cans and the substantial imprinting speed, the cans that have been imprinted are packed for delivery to clients of the can manufacturers. Then, as an example, when there is production of a given type of can, the produced cans are packed in pallets, wherein each of the pallets have about 6,000-15,000 units of imprinted cans, and all of them with the same imprint, that is, with the same finished art printed on them.

Thus, the client of the can manufacturers, mainly companies that produce beverages, receive loadings of pallets with an expressive number of cans, which follow the production line of this type of company which will fill the can beverages and deliver them to wholesalers, as for example, supermarkets. In other words, the supermarkets will also receive a large number of cans with beverages having the same finished art imprinted thereon.

In order to show an example of this, one can see in FIG. 2 the size of a standard-pallet containing about 500 cans. As one can see in this figure, there is a man of medium height beside the pallet that contains the cans, in this way, it is possible to have a quite significant idea of the number of cans being produced by a production line (it should be repeated: 2.5 million cans a day). Following this understanding, one will admit that the logistics present in the distribution and production of cans is significant.

However, as said before, the same sequence of production of cans has necessarily the same imprint arrangement, that is, the cans are virtually identical.

If there is the intention to make cans with different imprint arrangements, it is necessary, in the prior art, to interrupt the production line in order to change the printing plates 3*a*-3*f*.

In this regard, it is reminded that the beverage market is greatly influenced by the marketing of the companies of such segment. Thus, the imprint arrangements or finished arts on the cans are considered extremely important to such companies. This is because the consumer is often influenced to buy a given product by the visual aspect brought by the imprint on the cans.

This influence in the decision of the consumer has put more and more pressure on the marketing sectors of the beverage companies, since they require the launching of new and different imprint arrangements. However, in spite of the effort in these sectors, the professionals acting in this segment have significant limitation in their creation, namely due to the fact that the same type of beverage can produced in the same series (in the production of the can or in the packing of the product) necessarily always has the same finished art. This is not related to the limitation of the professionals involved in the creation of the layout or imprint arrangement of the cans, but to the fact that the same production in series and without interruption necessarily has the same imprint.

The present invention is provided to solve the problems discussed above and other problems, and to provide advantages and aspects not provided by prior apparatuses of this type. A full discussion of the features and advantages of the present invention is deferred to the following detailed description, which proceeds with reference to the accompanying drawings.

SUMMARY OF THE INVENTION

The invention in question relates to a can imprinting device that has a number of ink-cartridges depending on the need for colors to be printed onto the cans. These ink-cartridges supply ink to a number of printing plates that have finished arts that will impart the shapes and colorful imprint arrangements to the cans.

Such printing plates having finished arts are fixed to respective plate cylinders, so as to communicate with transfer blankets fixed to a transfer blanket drum to supply ink, whereby this ink comes from the ink-cartridges.

Thus, the transfer blankets arc, in turn, moved to transfer ink from the ink-cartridges to the cans, each of the transfer blankets having respective finished arts in low relief and free from ink from the ink-holders.

Moreover, it is also an objective of the invention to provide a process for the production of cans that use the above-described imprinting device. The steps of this process are: (i) supplying ink from the ink-holders to the printing plates present on the respective plate cylinders; (ii) supplying ink from the printing plates to transfer blankets by rotation of the printing plates; (iii) transferring ink from the transfer blankets to the cans; and (iv) forming finished arts of low relief present in the transfer blankets on the cans.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
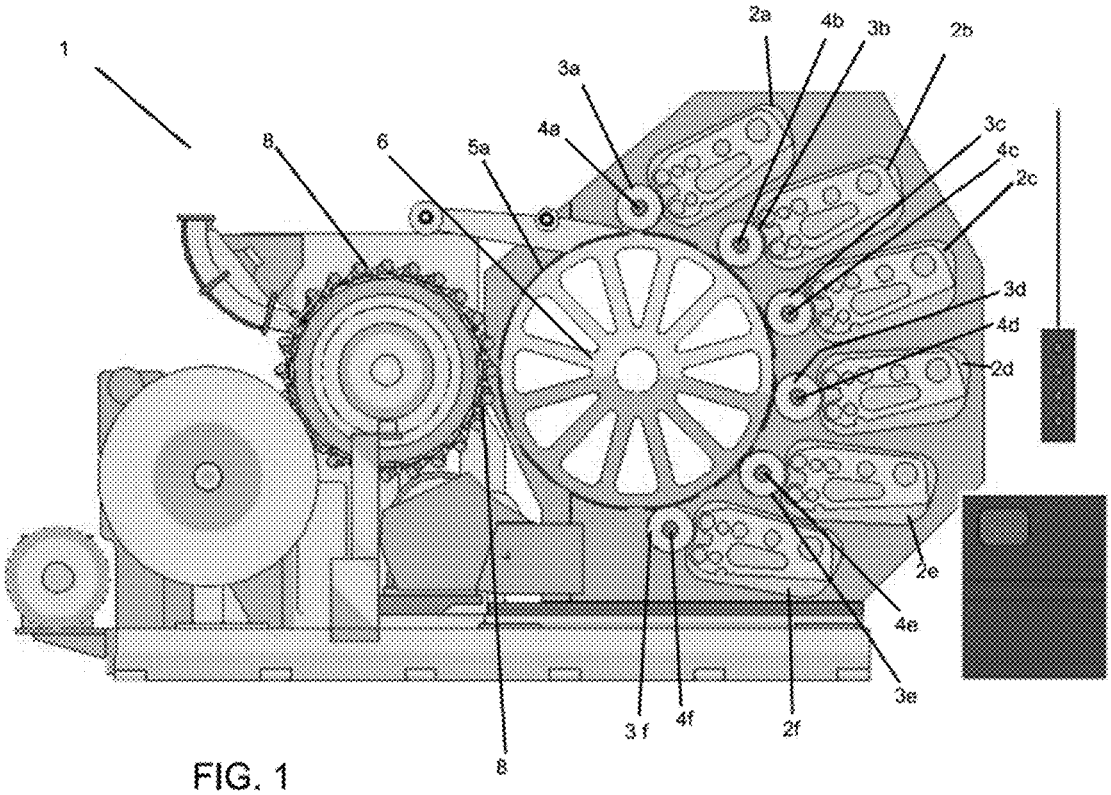
FIG. 1 (PRIOR ART)
FIG. 1 is a view of the imprinting device of the prior art.
Figure 2:
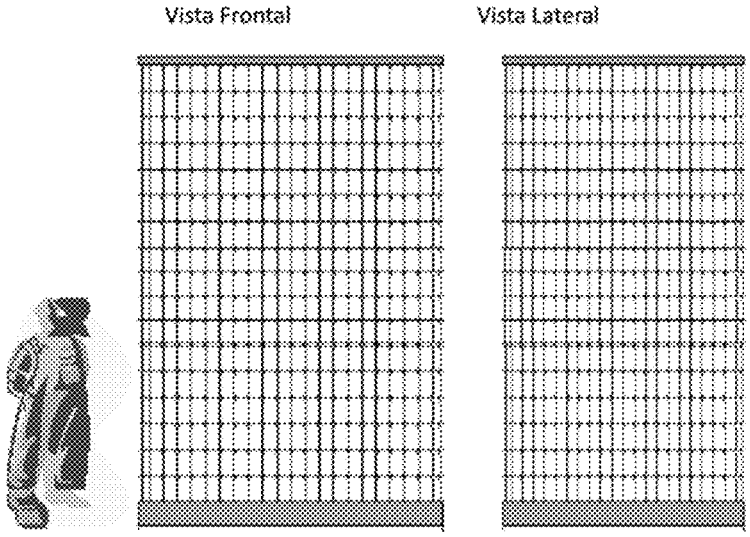
FIG. 2 (PRIOR ART)
FIG. 2 is a schematic view of a pallet compared with a man of medium height.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The object of FIG. 1 was described above in the explanation of the prior art. However, it is important to stress that the invention in question is applied to a can imprinter, that is, an imprinting device 1. The invention also relates to a modification introduced in such equipment, which enables one to imprint different finished arts onto cans, this imprinting takes place without interruption of the production.

In this way, it is possible to obtain, at the end of the can production line, pallets with different finished arts or imprint arrangements, i.e., instead of having the same sequence of can production with equal imprints, it is possible to have cans with different imprint arrangements, which has a substantially significant commercial effect. This is because it is possible for the same commercial establishment to receive cans containing, for example, the same product, but in cans which are different from each other.

This becomes very important because there is the possibility of a wide range of different creations for the marketing sectors of the companies that produce beverages. Thus, for instance, if there is a determined promotion or festivity of great magnitude, the object of the present invention enables the production of cans from the same production series, i.e. sequentially and continuously manufactured, to have different imprint arrangements, as for example cartoons, animal drawings, person names, country names, or still of sports activities. In short, the imprint arrangements or finished arts may be of different kinds and depend basically on the respective creativity of the creator of cans, since in light of the present invention there is no longer any technical limit that requires the interruption of imprinting to provide cans with different imprint arrangements or finished arts from the same uninterrupted sequence of production.

Figure 3:
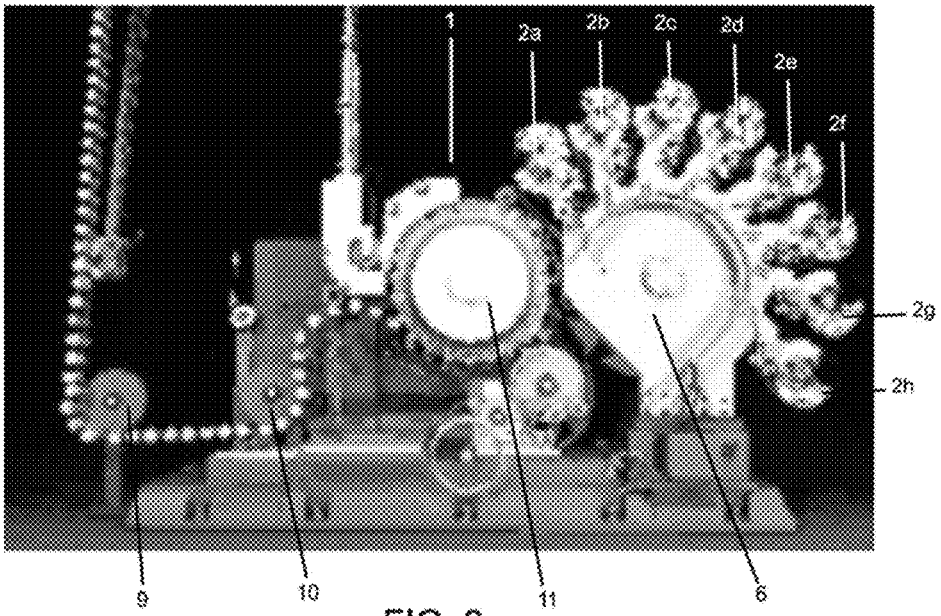
FIG. 3 is a perspective view of the imprinting device of the present invention.

The imprinting device 1 can be observed in greater detail in FIG. 3, which shows a can chain 7 having a plurality of cans 8 that are fixed to said can chain 7 in a rotatory manner. In the left portion of this FIG. 3, one can see cans 8 that come from the initial production processes, mainly from the mechanical shaping processes. These cans pass through a first directing wheel 9 and then through a second directing wheel 10. In this way, and with the aid of other elements of the equipment, not described or disclosed, it is possible to direct the cans 8 retained in the can chain 7 so that they will be led to the can carrying device or can indexer 11.

On the can indexer 11, the cans are then displaced in a circle around said indexer 11. Although the cans 8 are retained in the can chain 7, they still have the possibility of turning around their main axis, i.e. a central longitudinal axis about which the can is formed.

In the right portion of FIG. 3, one can see eight ink-cartridges 2*a*-2*h*, positioned in half-moon arrangement, which follow the same central axle 12. It can be noted that, in this embodiment of the invention, there is a limited number of ink-holders, but it is important to point out that this is a project option, and there may be a larger or smaller number of ink-cartridges 2.

Figure 4:
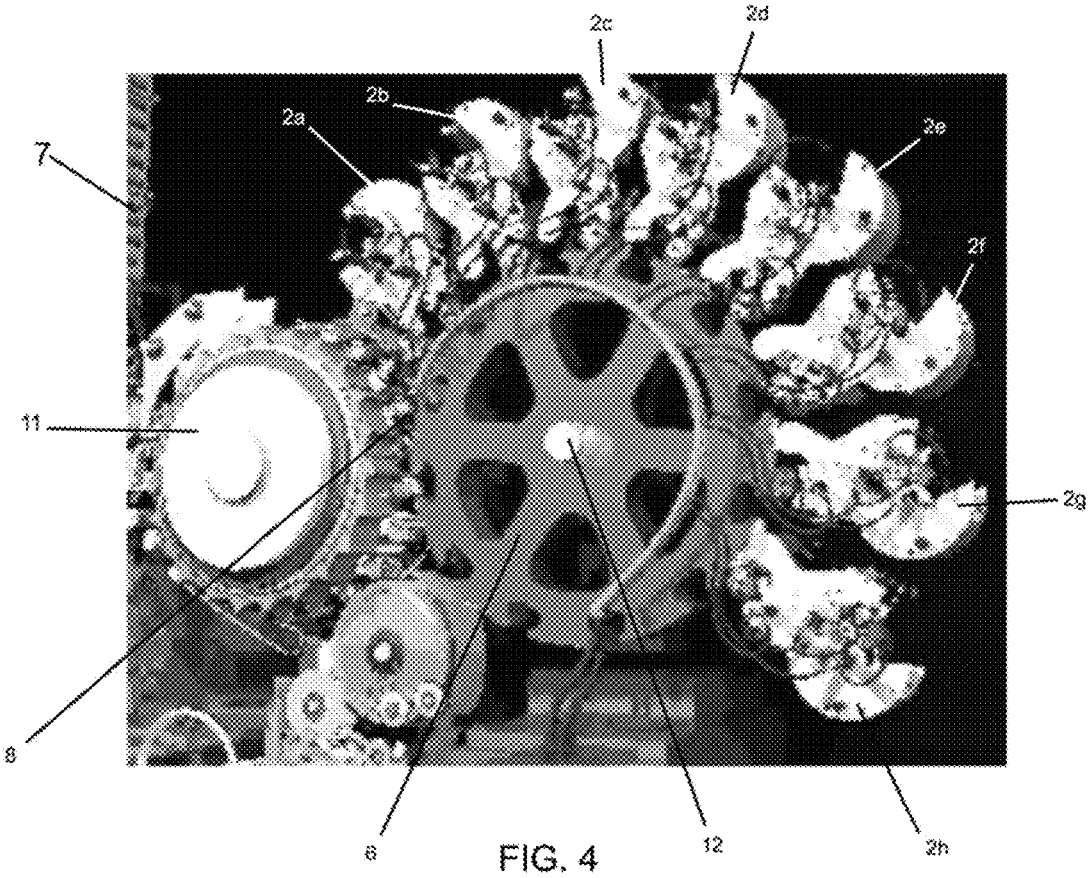
FIG. 4 is a perspective view of internal details of the imprinting device of the present invention.

In FIG. 4, which shows the right portion of FIG. 3, one can see in greater detail the inside of the imprinting device 1. The central axle 12 is, indeed, the transfer blanket drum 6, which has a radial arrangement of the ink-cartridges 2*a*-2*h* close to part of its perimeter.

However, the ink-cartridges 2*a*-2*h* do not rest on the transfer blanket drum 6, since between each ink cartridge 2*a*-2*h* and the transfer blanket drum 6 there are respective plate cylinders 4*a*-4*h*. As mentioned above, on the plate cylinders 4*a*-4*h* there are respective printing plates that have the finished arts in relief on their outer surface facing the transfer blanket drum 6.

Moreover, the printing plates 4*a*-4*h* are responsible for the communication between the ink-cartridges 2*a*-2*h* and the transfer blankets 5*a*-5*l*, which are placed on the outer surface of the transfer blanket drum 6. Obviously, there should be a positioning/interaction between the printing plates 4*a*-4*h* and the transfer blankets 5*a*-5*l*, so that the transfer blankets 5*a*-5*l* can interact in a precise manner with the cans 8 to be imprinted.

Figure 5:
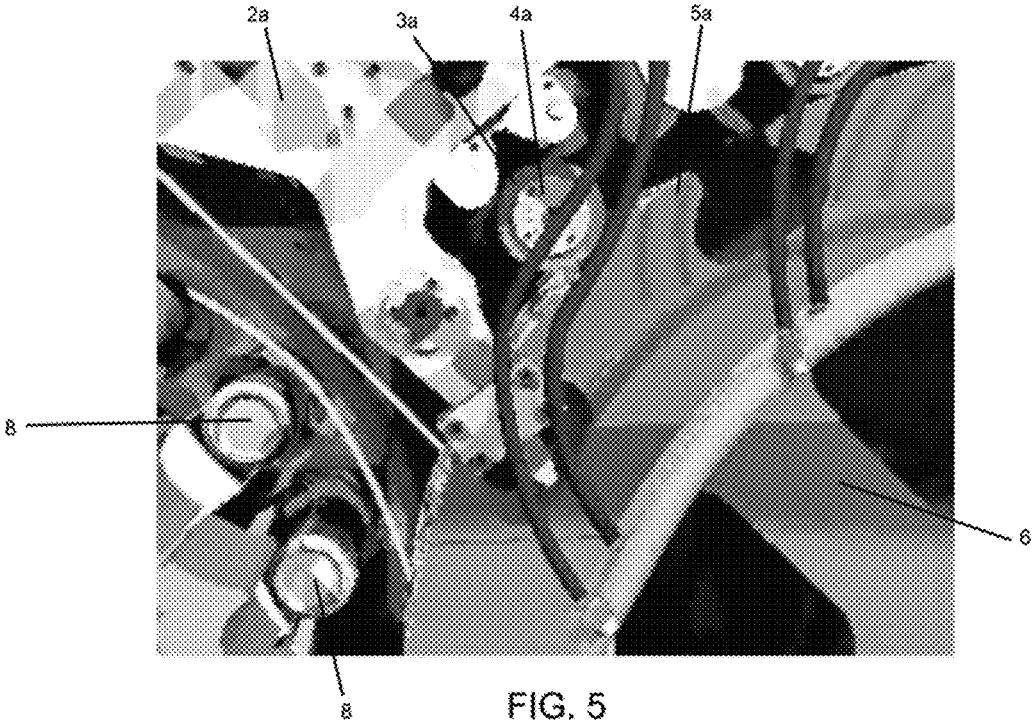
FIG. 5 is an enlarged perspective view of internal details of the imprinting device of the present invention.

With a view to exemplify how the interaction between the components responsible for the imprinting takes place, FIG. 5 shows an internal portion of the imprinting device 1. For practical purposes, one will demonstrate only the functioning of a part of the transfer of ink for imprinting, since the process is analogous for each ink-cartridge.

Figure 6:
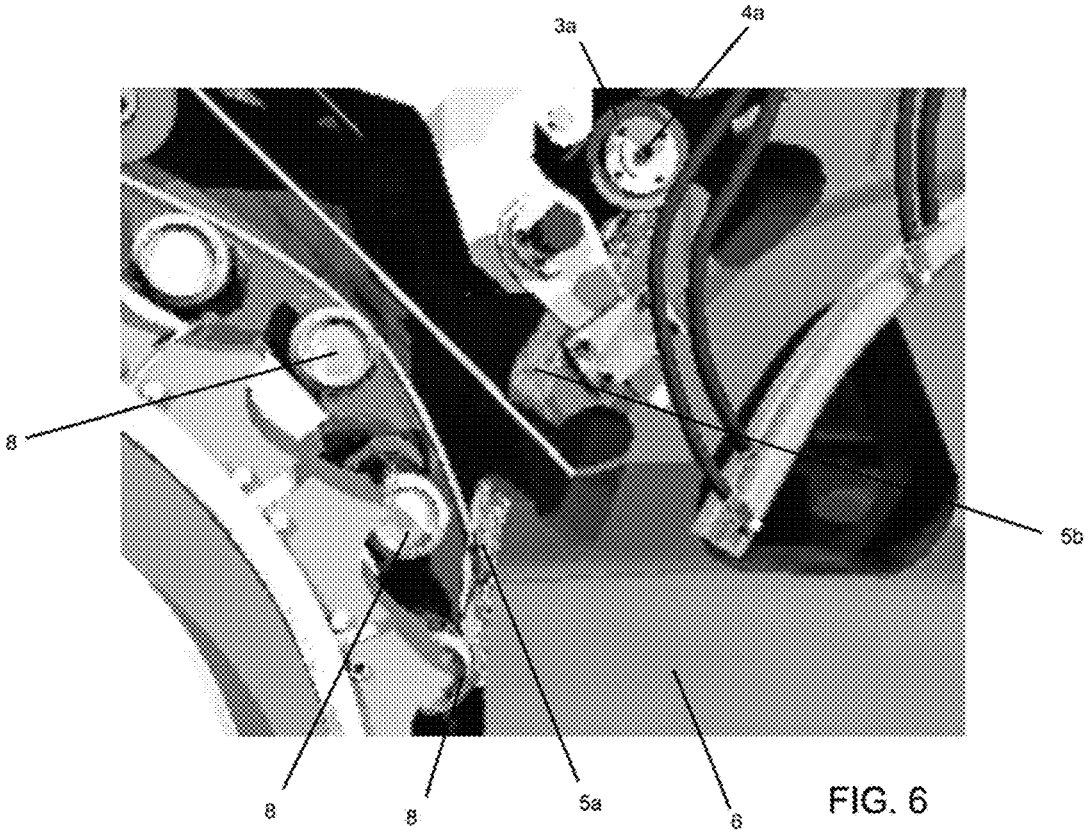
FIG. 6 is an enlarged perspective view of internal details of the imprinting device of the present invention.

In FIGS. 5 and 6, the process, also an object of the present application, can be better understood, wherein the ink cartridge 2*a* supplies ink to the printing plate 3*a* present on the plate cylinder 4*a*, and ink is transferred chiefly to the high reliefs existing there, which have a finished art or imprint arrangement.

The plate cylinder 4*a*, upon coming into synchronized contact by the printing plate 3*a* with the transfer blankets drum 6, supplies ink from its high relief to the transfer blanket 5*a*, wherein this takes place by rotation of the printing plate that transfers the ink present on high relief to the transfer blanket 5*a*.

Afterwards, and by opposite directions rotation of the transfer blanket drum 6 and the can indexer 11, the transfer blanket 5*a* that has the ink from the printing plate 3*a* transfers the ink present on the transfer blanket 5*a* to the can 8, which is rotated under some pressure against the transfer blanket 5*a*.

It is pointed out that, if it is necessary to imprint more than one finished art or different colors onto the can 8, the transfer blanket 5*a* will also have passed through the other printing plates 3*b*-3*h* present on the respective plate cylinders 4*b*-4*h*. The same occurs successively with the other transfer blankets 5*b*-5*l* that have the finished art coming from any printing plates that are necessary for obtaining all the finished art of different colors on the cans 8 to be imprinted.

Thus, the finished arts present on the printing plates are transferred to the transfer blankets, which in turn transfer ink to the cans 8.

Figure 7:
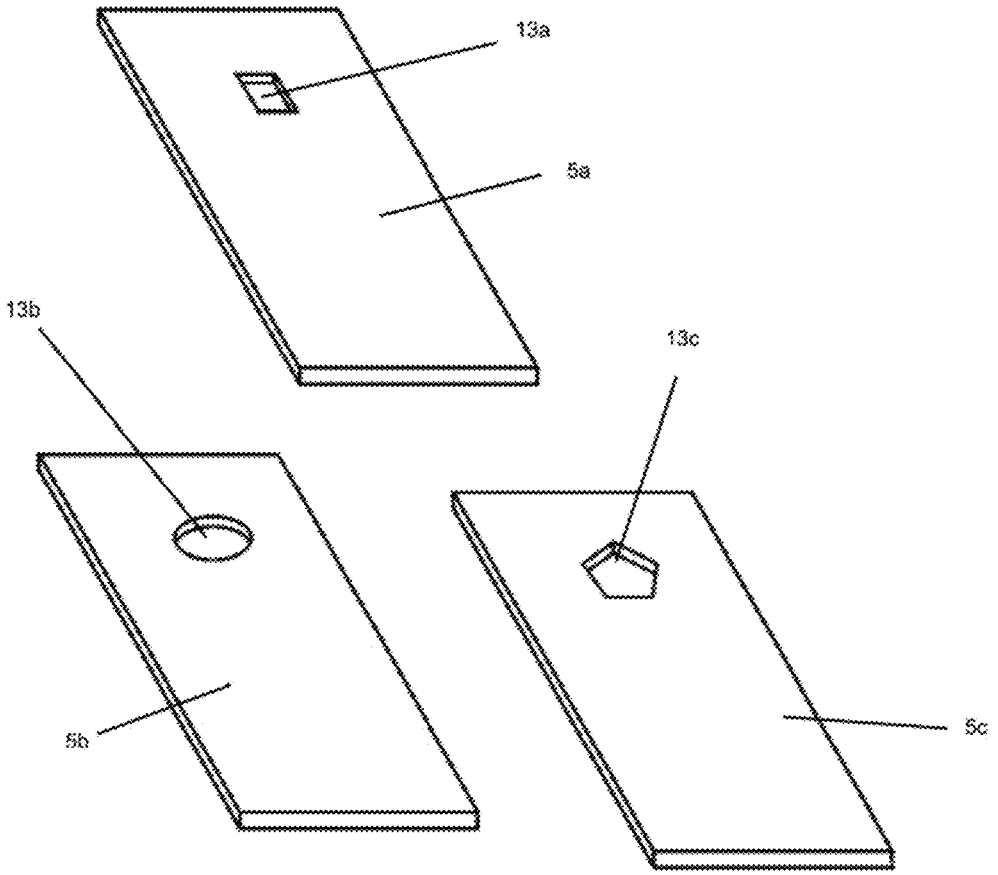
FIG. 7 is a perspective view of a set of transfer blankets.

The transfer blankets of the present invention can be seen in FIG. 7.

Usually, that is, in the prior art, these transfer blankets are only smooth surfaces that are used as ink transferring means between the printing plates 3*a*-3*h* and the cans 8 to be imprinted. However, in the present invention the transfer blankets also have the function of being a graphics mean that has influence on the finished arts of the cans 8 to be imprinted.

In the example of FIG. 7, one demonstrates only three transfer blankets 5*a*-5*c*, but there may be several blankets with low relief according to the need for different finished arts on the cans 8. In other words, the number of different finished art or graphs from the blankets on the cans is limited to the number of blankets present on the blanket drum 6.

In the preferred embodiment of the present invention one has opted for using a transfer blanket drum with twelve blankets 5*a*-5*l*, but, as mentioned before, only three blankets are shown in FIG. 7.

It is of the utmost importance to note that the transfer blankets 5*a*-5*c* have respective low reliefs 13*a*-13*c*, wherein the low reliefs of finished arts are in reality low relief 13*a*-13*e* with different shapes. Therefore, there is a finished art in low relief 13*a* present on the blanket 5*a*, a finished art in low relief 13*b* present on the blanket 5*b* and another finished art in low relief 13*c* present on the blanket 5*c*.

Thus, when there are three types of blankets 5*a*-5*c* with different finished arts in low relief it is possible that all the finished arts coming from printing plates will be transferred by ink to the transfer blankets 5*a*-5*e*, so that the cans 6 will be imprinted in this way.

However, since each of the finished arts 13*a*-13*c* is in low relief, there will be no ink in this low-relief portion of each of the blankets. There will be no contact, in this low-relief region, between the blanket and the cans 8 to be imprinted. Indeed, the original color of the can 8 will remain in this region free from ink or free from contact between the can 8 and the respective blanket that is transferring the ink from the transferring blankets to the can 8.

Figure 8:
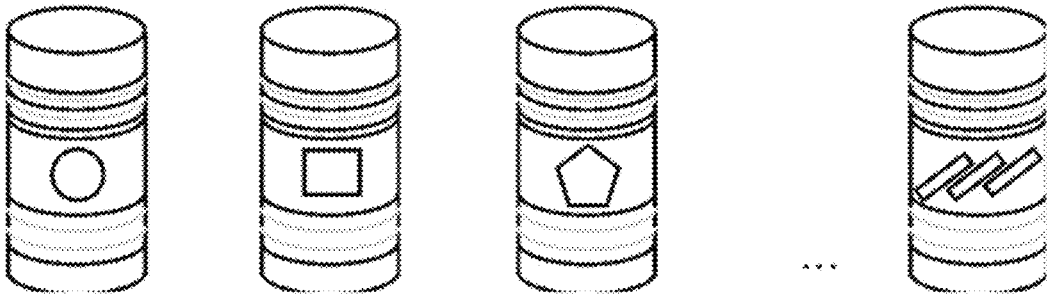
FIG. 8 is a perspective view of a set of imprinted cans according to the present invention.
Figure 9:
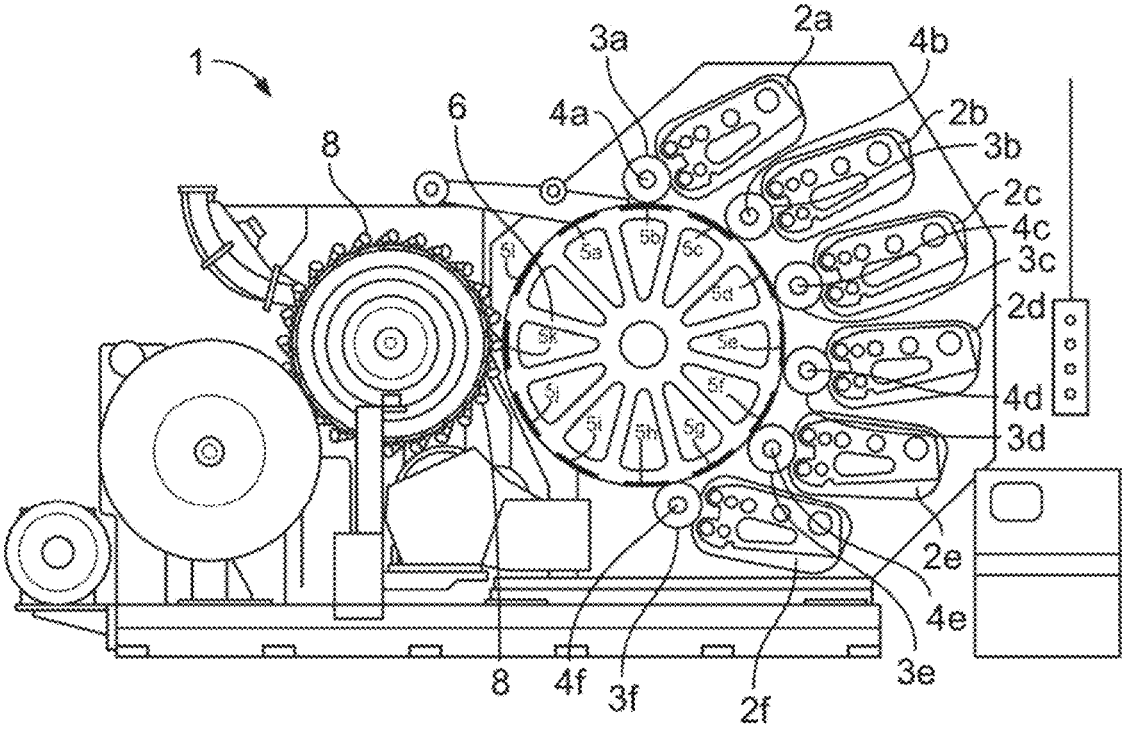
FIGS. 9-16 are alternate versions of FIGS. 1-8, respectively.
Figure 10:
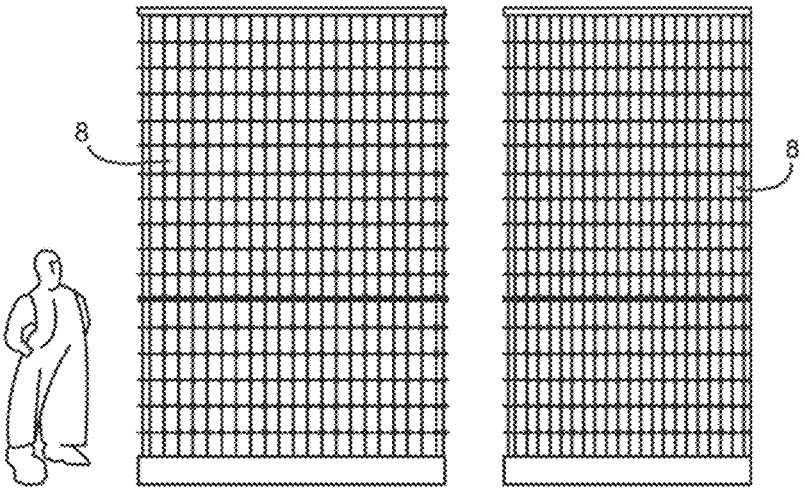
Figure 11:
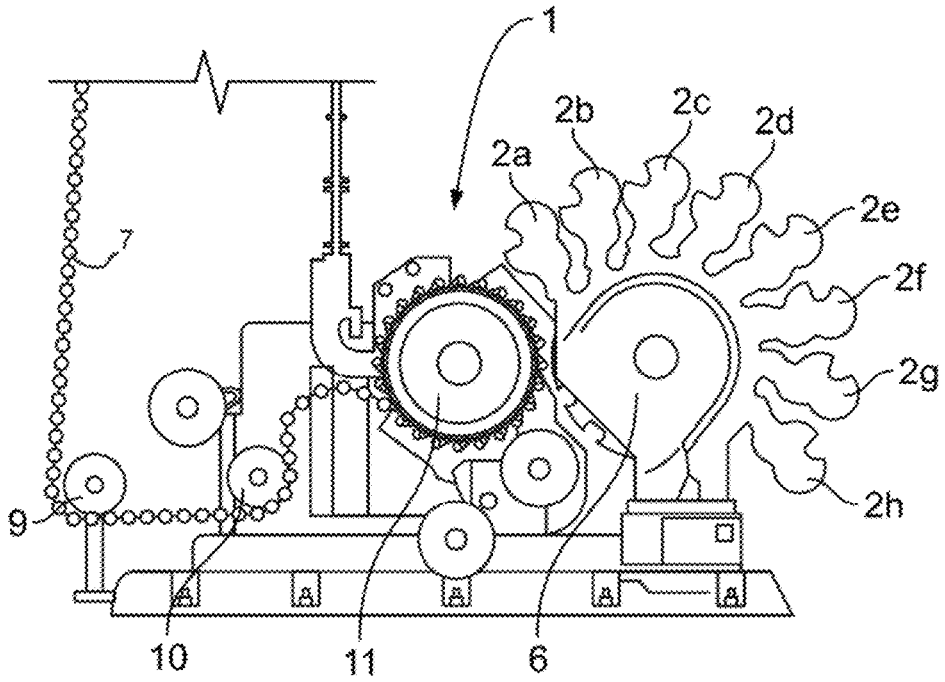
Figure 12:
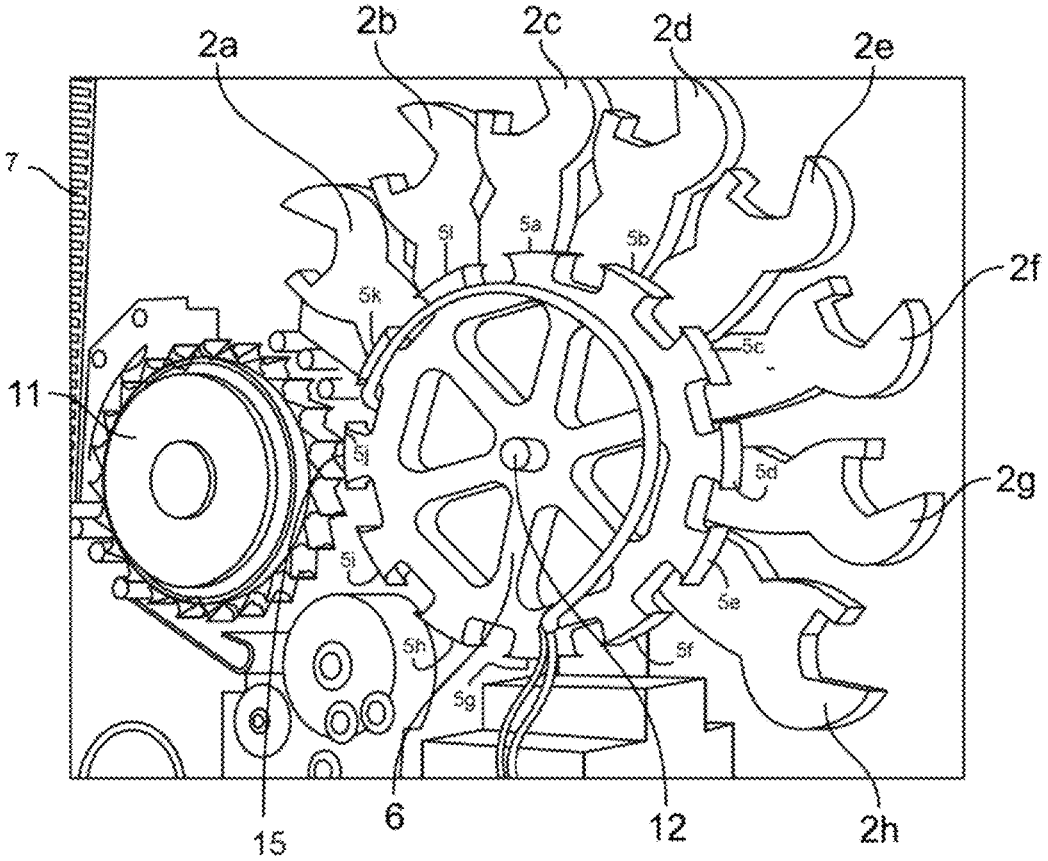
Figure 13:
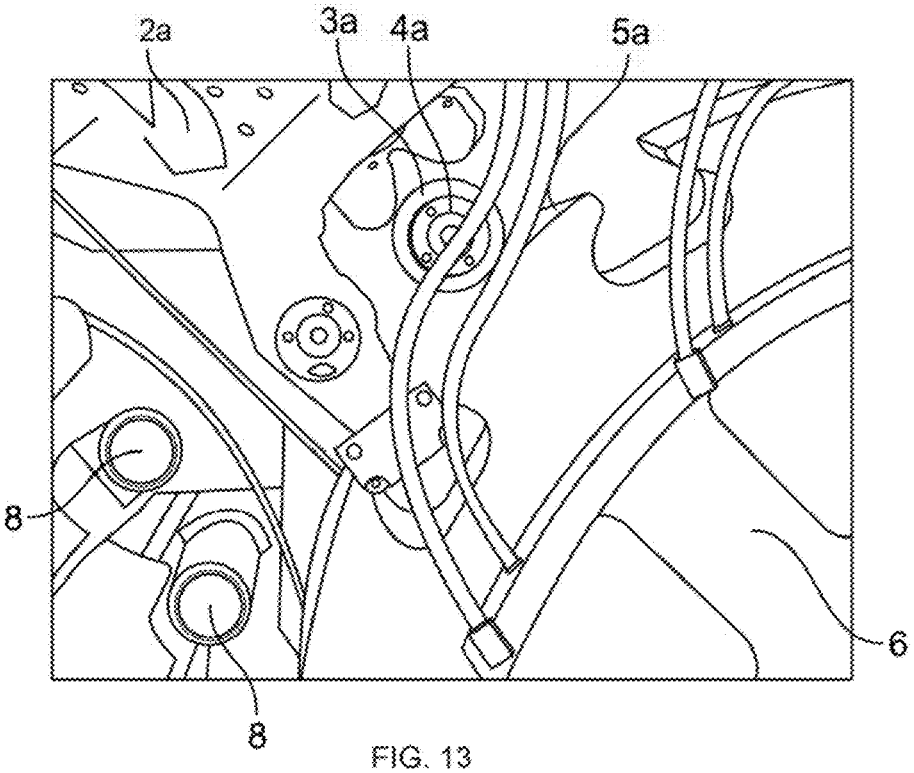
Figure 14:
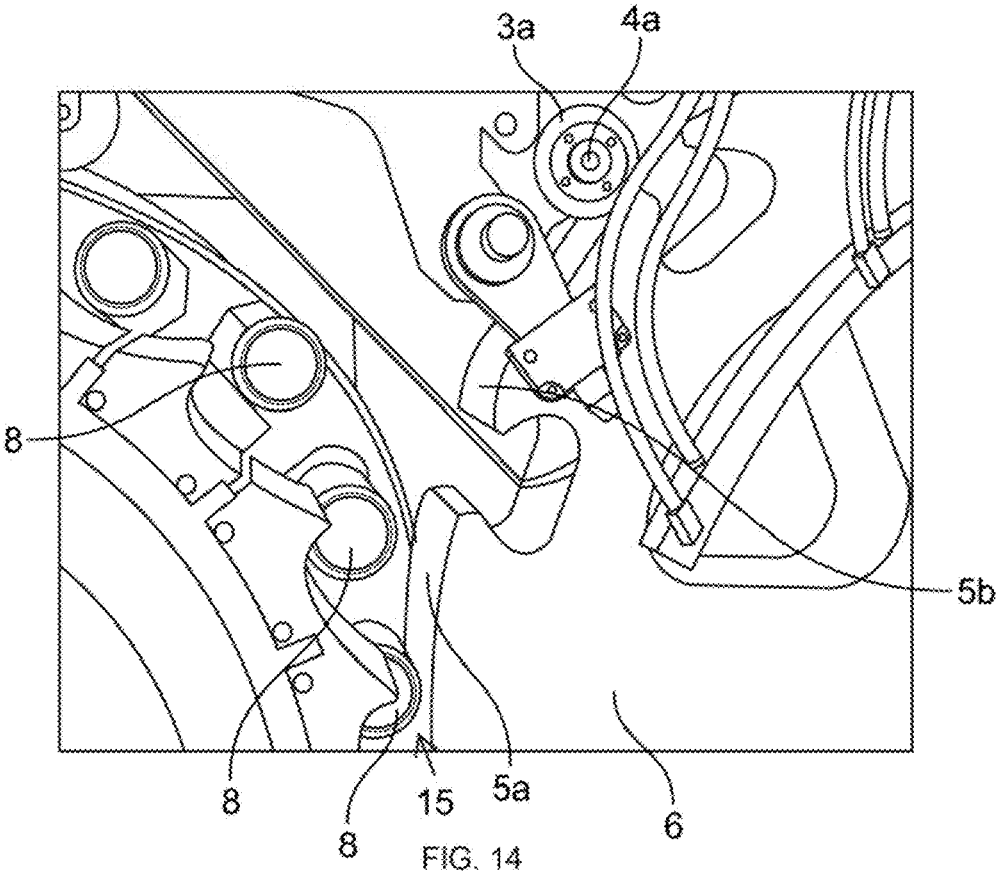
Figure 15:
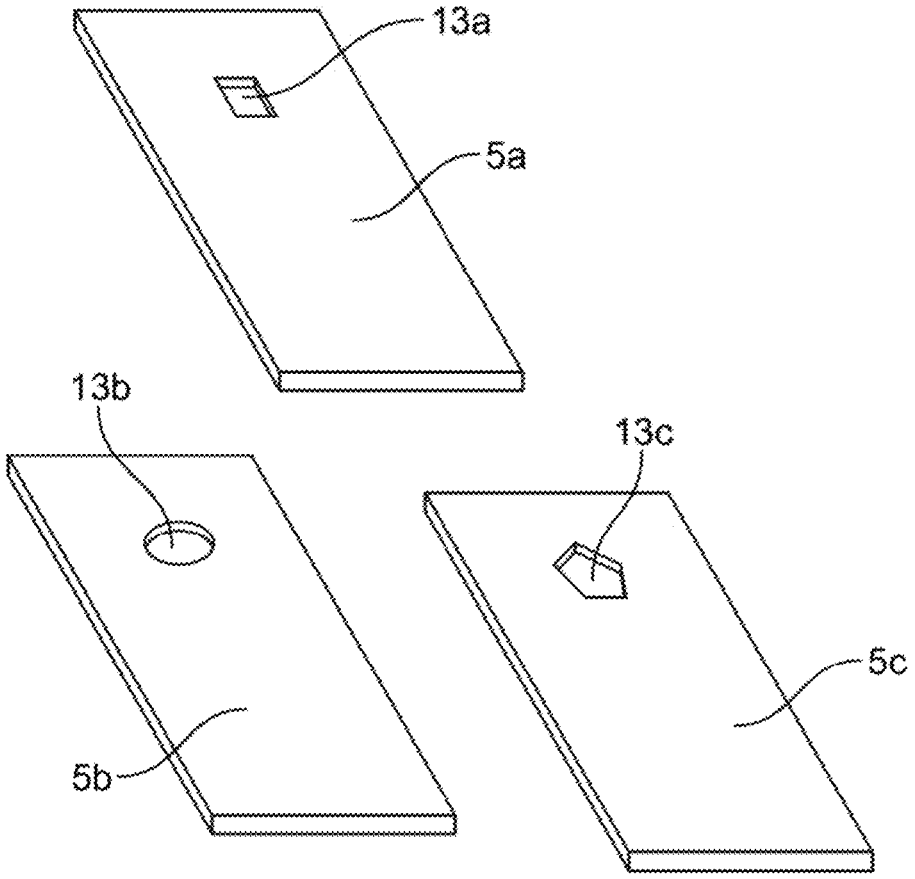
Figure 16:
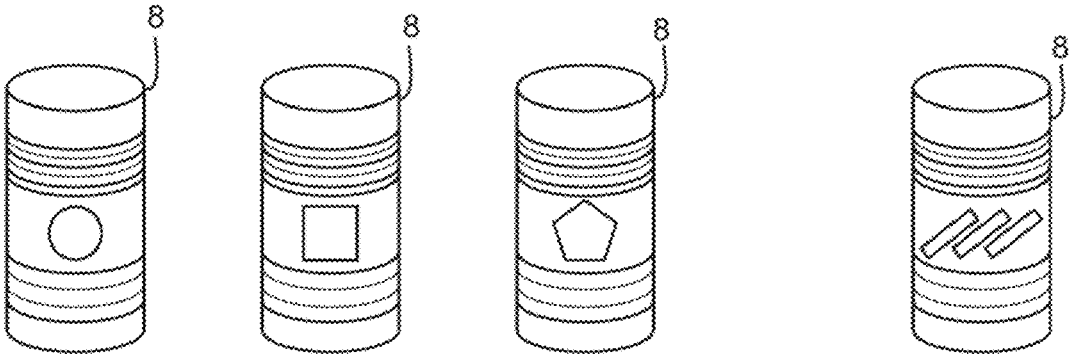

Therefore, if there is a low-relief finished art 13*a* on the blanket 5*a* which, in the present example, a circle, there will be no imprint or ink transfer from this low-relief region to the can 8. Therefore, a first finished art is formed on the can 8, as shown in FIG. 8, which is in the form of a circle, for explanation purposes.

Thus, the next can 8 to be imprinted will also receive ink from the printing plates, but from the next blanket. In this example, the transfer blanket 5*a* has a low-relief finished art 13*b* in the form of a rectangle. In this way, the can to be imprinted will have a second finished art in the form of a rectangle in the original color of the can.

Following the same logic, a third can to be imprinted will also receive ink from the printing plates, but from a subsequent blanket other than the first two ones. This third transfer blanket 5*c* has a low-relief finished art 13*c* in the form of a pentagon, so that the can to be imprinted will have a third finished art in the form of a pentagon in the original color of the can.

As already mentioned, the number of different finished art on the cans will only be limited to the number of blankets present on the blanket drum 6.

It is further stressed that the finished arts present on the blankets—that are portions of removed material of the blankets—are arranged directly on the blankets without any other type of layer on the blanket, so that the latter can have the printing function, i.e., the function of having a finished art that will be present on the imprinted can.

It is reiterated that the low reliefs or portions of material removal will represent absence of ink, which will enable one to view the original color of the can, be it the color of the aluminum or of a coating of other coloring that the can to be imprinted already has.

The finished art produced by the low relief will be a final contour on the imprinted can, which will provide a clearer finished art, and the low relief present on the blanket will have less problems with usual imprinting aspects, such as, for instance, ink stains, smears or any other type of problem related to the high-precision imprinting or detailing.

In FIG. 8, one demonstrates by reticence that there is the possibility of more than three types of finished arts from the imprinting process and device of the present invention. This is verified through a subsequent can with another finished art in the form of three consecutive lines.

Obviously, the finished arts or graphic arrangements are not limited to geometric shapes, but may be any type of graphic means that one desires to print on the cans 8, as for example, names of persons, of teams, figures, etc. In this regard, the limitation is no longer in the imprinting process, but rather in the creativity of those who develop the finished arts to be applied to the imprinted cans.

In the view of the foregoing, it is possible to have, in the same uninterrupted production line, cans with different finished arts, which was possible only with the interruption of the production line until the advent of the present invention.

However, it was not feasible, in terms of logistics, to obtain cans from the same production sequence with different finished arts on the same pallet, or still delivered to the beverage manufacturers, such as supermarkets. However, this has become possible with the present invention.

According to another embodiment of the present invention, artwork with improved resolution and/or increasing complexity can be generated using transfer blankets 5*a*-5*l* with improved, highly detailed low-relief features. In the prior art, the printing plates 3*a*-3*h* carry detailed art in high relief as described above. The high relief art is transferred to a transfer blanket 5*a*-5*l* which then prints the can 8. As described above, the transfer blankets 5*a*-5*l* may be supplied with low relief art wherein the can 8 will have an area devoid of ink corresponding to the low relief art on the transfer blankets 5*a*-5*l*. By way of example, under a prior art printing process, printing plate 3*a*-3*h* will have a relief feature. To print, for example, "BRAND X SODA" on a can, a printing plate 3*a*-3*h* has "BRAND X SODA" in high relief on a surface of the printing plate 3*a*-3*h*. Then the ink is applied to the high relief on the surface of the printing plate in the shape of "BRAND X SODA".

In the present invention, it is contemplated that improved and more flexible high resolution low-relief features can be generated by treating the transfer blankets 5*a*-5*l* with a suitable laser beam. In this embodiment, portions of the blanket 5*a*-5*l* are removed by laser treatment. Through laser ablation, very different, highly complex and detailed relief patterns can be created on each of the transfer blankets 5*a*-5*l*, rather than simple shapes and the like as discussed above.

For example, each blanket 5*a*-5*l* is typically produced from a non-metallic material such as a rubber (or a polymer or composite) rectangle the size of a legal paper. Each blanket is typically ⅛ to ¼ inch thick (3.2 mm to 6.4 mm). Shading can be generated by varying the depth and size of the low-relief features. In practice, printed areas on a finished can be made lighter or darker depending on how much of the surface of a particular transfer blanket 5*a*-5*l* is removed during the laser treatment process.

Basically, there are two different properties that are essential to the laser treatment discussed herein: tolerance of the cut and surface finish. Standard technology laser cutting equipment that has been in use for 5+years uses a focused laser beam. The spot size of the laser beam determines the tolerance and the surface finish. Older laser cutting machines that have been in service for 5+years, have 0.008 to 0.010 inches spot diameter size (0.2 mm to 0.3 mm). Newer laser cutting machines a focus within a spot diameter size of 1-2 thousandths (0.001 to 0.002 inches) of an inch (0.03 mm to 0.05 mm). Generally, using a laser as contemplated by the inventors, a low-relief feature having a surface finish or depth as little as 0.001 inches (0.03 mm) or less can be created.

In creating high resolution low-relief features on a transfer blanket 5*a*-5*l* using a laser cutting apparatus, the apparatus must position and move the beam accurately. Because the beam is moving in two dimensions (e.g., an X & Y coordinate system) speed of the laser beam movement must be controlled. For example, if a straight cut is being generated, the laser beam speed across the surface of the transfer blanket needs to be constant. Once a curved cut or low-relief pattern is desired, the speed at which the laser beam travels must be varied so that the laser beam can affect the cut itself. Software and algorithms calculate the proper speed of the laser beam along the surface as cuts are made. Suitable transfer blankets have been manufactured using a 420W Stork® brand laser engraver set at a speed of about 12 m/$_s$. The result is a smooth cut and a smooth surface finish.

To avoid a resultant blurring effect on a finished can caused by the low-relief features produced by laser ablation on the transfer blankets 5*a*-5*l*, the surface of the transfer blanket 5*a*-5*l* must have a better surface finish, especially, or primarily, an edge of the transfer blanket surface between the low-relief laser ablated surface and an untreated surface. The better the edge surface the laser creates, the better the printed edge of the finished product. This better surface finish will result in a cleaner, crisper image.

Final surface finish of a laser treated transfer blanket 5*a*-5*l* is dependent on the transfer blanket 5*a*-5*l* thickness prior to laser treatment. A thicker transfer blanket will have a rougher final surface finish. The laser does not cut as smoothly in thicker substrates.

However, depending on the algorithm, the speed, and the arc, smoothness of the laser cut can be improved. When a laser is cutting an arc or intricate shapes, the algorithm will change the speed and how the laser beam is moving. This results in a cleaner shape.

In generating transfer blankets of the present invention, laser beam spot size was generally on the order of 0.003 inches (0.08 mm). However, such a spot size is inadequate for producing cans with high resolution graphics devoid of ink as contemplated herein. More specifically, the inventors determined that transfer blanket low-relief pattern quality suffers when a laser beam spot size greater than 0.002 inches (0.05 mm) is employed. This will result in a target surface finish of about 125 to 250 micro inches (about 0.002 inches or 0.05 mm).

Figure 17:
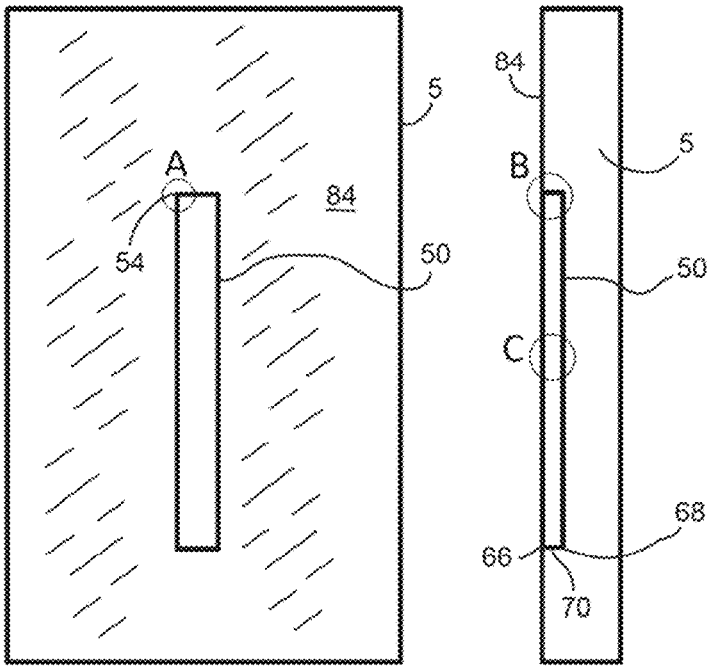
FIG. 17 is a top and cross-sectional view of a transfer blanket showing zones A, B, and C.

To illustrate this aspect of the invention, referring to FIGS. 17-23, a transfer blanket 5 is treated with a laser to produce a low-relief rectangle 50. A zone A of FIG. 17 represents a corner 54 of the rectangle on an upper surface of the blanket 5 forming an edge between a laser treated portion of the blanket 5 and an untreated portion of the blanket 5; a zone B represents inside corners 66,68 of the rectangle 50; and a zone C represents a laser treated surface finish upon the rectangle floor.

Figure 18:
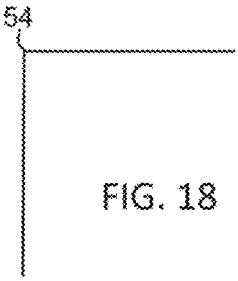
FIG. 18 is a magnified view of zone A from FIG. 17.
Figure 19:
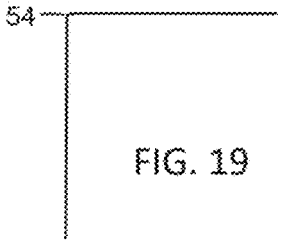
FIG. 19 is a magnified view of zone A from FIG. 17.
Figure 20:
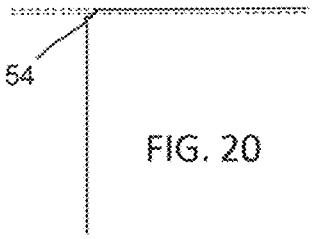
FIG. 20 is a magnified view of zone A from FIG. 17.

Referring to FIGS. 18-20, in zone A, the corner 54 quality is a function of the laser beam design, accuracy of the XY coordinate axis positioning, and the blankets material. As shown in FIG. 18, a sharp 90° corner is difficult to achieve. Generally, the corner exhibits a certain radius of curvature as shown in FIG. 19. Regarding the edge level quality in FIG. 19, the edge quality of the corner 54 is material dependent because projection of the blanket material may take place during laser treatment. Thus, the contour of the cut must be within 2 parallel lines as shown in FIG. 20.

Figure 21:
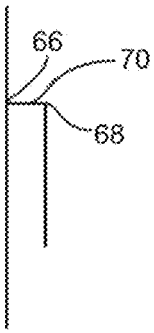
FIG. 21 is a magnified view of zone B from FIG. 17.
Figure 22:
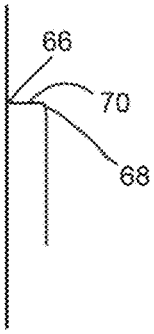
FIG. 22 is a magnified view of zone B from FIG. 17.
Figure 23:
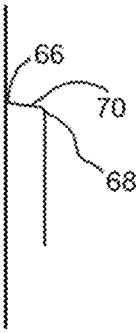
FIG. 23 is a magnified view of zone B from FIG. 17.

Referring to FIG. 21, in theory, in zone B, sharp angles at the inside corners 66,68 would result from laser ablation forming the rectangle 50. However, as shown in FIG. 22, due to the laser milling process, there will be 2 separate curvatures at the corners 66,68, a first radius of curvature on the edge of the corner 66 forming the contour of the rectangle and a second radius of curvature at the corner 68 forming a bottom of the ablated groove. These radii are specific to the laser process used (laser type, laser parameters, material type). As shown in FIG. 23, a wall 70 between the corners 66,68 is angled between 75° and 105°, typically angled outwardly greater than 90°, more specifically 105° ±5°. In practice, substantially 90° angles are formed at the corners when forming a solid image, such as the rectangle 50 shown. When producing micro portions or dots as described below, the wall 70 will generally be angled according to the parameters set forth above.

Further, the corner 66 forming the contour of the rectangle is critical in establishing the high level of graphic quality discussed hereinafter. A surface finish of the transition between an upper surface of a blanket 5 on which ink is deposited by a printing plate 3 (high relief portion) and the recessed portion of the blanket 5 (low relief portion) is less than or equal to 3.5 $R_a$, preferably less than 3.5 $R_a$, and more preferably 3.0 $R_a$±0.1 $R_a$. Additionally, the most preferable surface finish in this region has 3.33 $R_{max}$. Adequate blankets have been manufactured having a surface finish of about 3.03 $R_a$.

In zone C, the rectangle floor's surface finish is a function of laser technology and blanket material. A target of 125 to 250 micro inches (about 0.002 inches or 0.05 mm) for the surface finish is preferred to achieve desired results. Suitable blankets having a surface roughness of 3.03 $R_a$ (3.33 $R_{max}$) have been produced having a floor depth of about 0.015 inches (0.38 mm). It has been determined that the floor depth of about 0.015 inches (0.38 mm) performs well in that ink is not transferred from the low relief floor to the beverage container 8 when the floor is at least 0.015 inches (0.38 mm).

Figure 24:
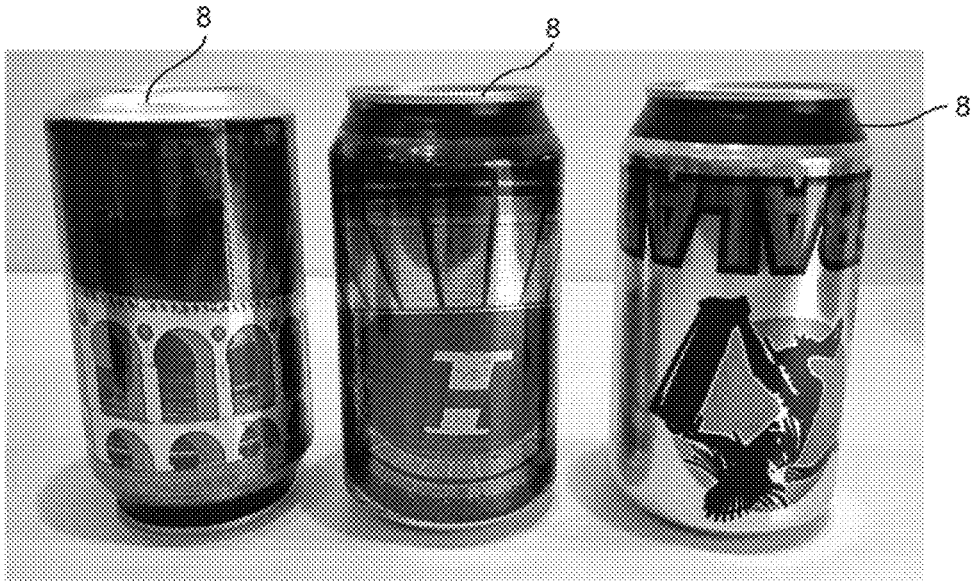
FIG. 24 is a photograph of three sequentially produced cans according to the principles of the present invention.
Figure 25A:
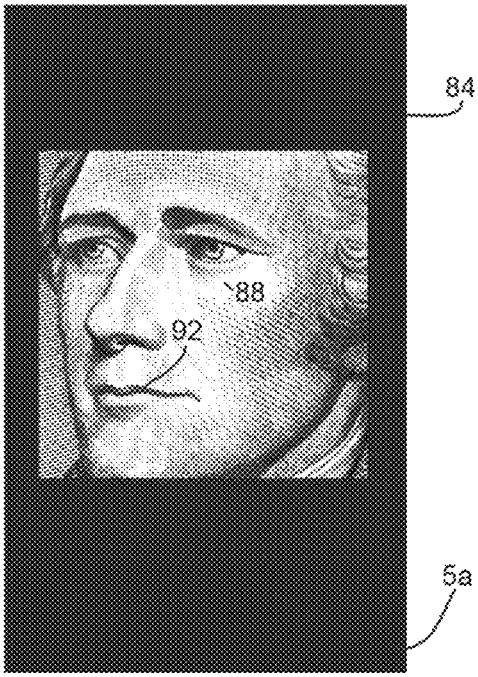
FIG. 25A-D are front views of blankets of the present invention.
Figure 25B:
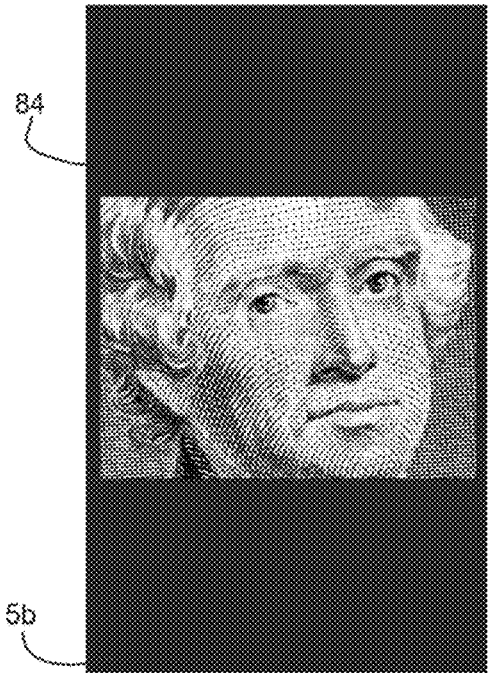
Figure 25C:
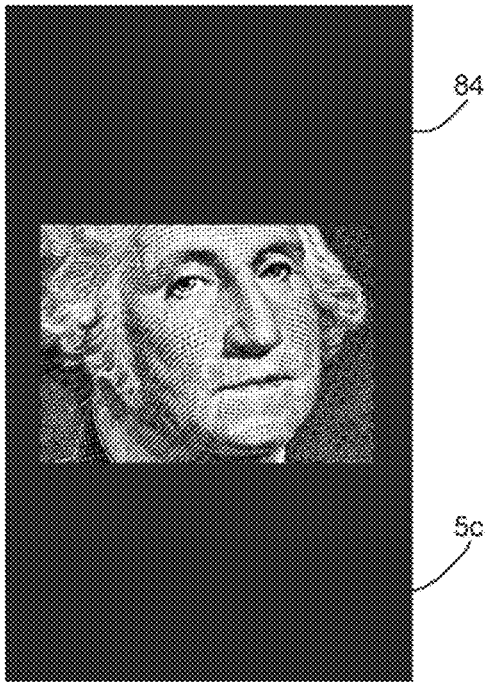
Figure 25D:
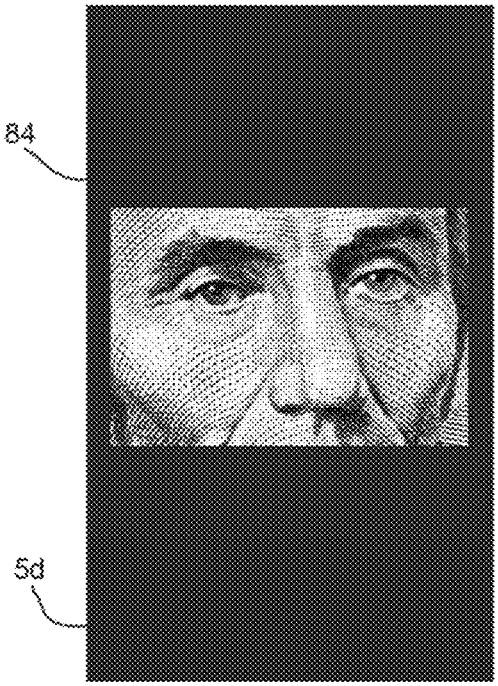
Figure 26:
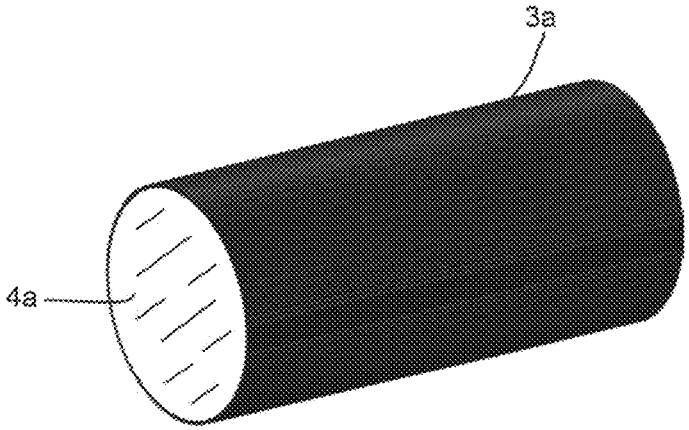
FIG. 26 is a perspective view of an inked printing plate affixed to a plate cylinder wherein substantially an entirety of the inked surface of the printing plate is in high relief.

FIG. 24 shows an example of three sequentially produced beverage containers which may be produced having highly detailed unique art, relative to each other. These cans have gray scale art produced with three unique blankets 5*a*-5*c* according to the present invention. Note that much of the detail is achieved by way of the natural metallic color of the metallic can produced by low relief features on the blankets 5*a*-5*c*. In this example, at least one of the printing plates has a relatively large portion of the upper surface in high relief If the blankets 5*a*-*c* were typical blankets used in the art, the cans would have no art other than in an area of the can sidewall corresponding to the high relief portion of the printing plate other than an overall black color. In other words, but for the relief art on the blankets 5*a*-5*c*, the cans would at least have a very large black portion. However, when blankets 5*a*-5*c* according to the present invention are employed having low relief features, the cans exhibit art in a color combination comprising the background color (black) and highly detailed unique art formed by the original color of the can. This is accomplished by the printing plate having substantially a large area of an upper surface in high relief with ink deposited thereon which delivers the ink to high relief portions of the blanket (black). The blanket has highly detailed unique art laser etched thereon in low relief. The beverage container can otherwise have art detail provided by the remaining printing plates. In other words, each beverage can produced in sequence up to a finite number of beverage cans, typically less than fifteen, will have a first art identical to the other beverage cans in the sequence and a second art unique to the individual beverage can.

FIGS. 25A-D are front views of blanket 5*a*-5*d* of the present invention which illustrate how low relief features produced according to the methods described above can be used to generate highly detailed art when used in combination with printing plates as described above. Here, low relief features can be varied in size and location to produce shading and detail which results in a very complex image. According to further principles of the invention, a plurality of unique blankets can be introduced into a rotary inking apparatus as described above wherein a corresponding plurality of different resultant cans can be produced continuously and sequentially. For example, in the blanket illustrated, a man's face is depicted. In practice, the can imprinting apparatus may be outfitted with a plurality of blankets 5*a*-5*d*, e.g. four, wherein each exhibit unique low relief features, relative to each other, to produce 4 cans sequentially, wherein each of the four cans has a different art thereon, for instance four different men's faces in the example illustrated. It should be noted that the number of different sequentially produced cans is only limited by the number of blankets a particular imprinting apparatus is capable of using. In the previous example, as few as two and as many as twelve different sequentially produced cans may be produced continuously.

More particularly to FIGS. 25A-D, each blanket 5*a*-5*d* has been treated with a laser to remove portions of an upper surface 84 of each blanket 5*a*-5*d*. Using a laser having a laser beam spot size less than 0.002 inches (0.05 mm) very precise removal of the blanket material can produce micro high relief and low relief portions 88,92 of the upper surface 84 of the blankets 5*a*-5*d*. A black ink has been applied to the upper surface 84 of the blankets 5*a*-5*d*. It follows that the high relief features 88 are black in the figures, and the low relief features 92 are a lighter color. The resultant sequentially and continuously imprinted cans have unique art heretofore unrealized in the can making art.

According to the invention, finished art may be delivered to each container in a sequence of continuously, individually decorated beverage cans. Printing plates may be provided to indirectly deliver (via transfer blankets) identical finished art to each beverage can in a sequence. Individual transfer blankets may have high and low relief features to deliver unique art to each beverage can in the sequence, such that two or more adjacent beverage cans in a sequence of decorated beverage cans may each exhibit some identical decorations or art (originating from the printing plates) and some unique art (originating from the transfer blankets).

According to an embodiment of the invention and further to the features described above, a can imprinting apparatus 1 has a plurality of ink cartridges 2*a*-2*h*, preferably each of a different color. A plurality of printing plates 3*a*-3*h* are rotationally mounted on the apparatus 1, preferably as described above. Each printing plate 3*a*-3*h* is in communication with a corresponding ink cartridge of the plurality of ink cartridges 2*a*-2*h* and has a finished art in high relief. A first printing plate in the plurality of printing plates 3*a*-3*h* has a first finished art comprising a high relief portion of the first printing plate. This high relief portion comprises a portion of an upper surface of the first printing plate and is adapted to receive an ink from one of the plurality of ink cartridges.

The apparatus 1 further has a plurality of transfer blankets 5*a*-5*l*. The plurality of transfer blankets 5*a*-5*l* are rotationally mounted to the apparatus such that each transfer blanket rotates about a single central hub or axel. A first transfer blanket has a plurality of low relief features and a plurality of high relief features on an upper surface thereof. The plurality of low relief features cooperate with the plurality of high relief features to form a second finished art comprising a first character. The first character includes a shading pattern to simulate depth and contour. A second transfer blanket also has a plurality of low relief features and a plurality of high relief features on an upper surface thereof. These plurality of low relief features cooperate with the plurality of high relief features to form a third finished art comprising a second character. The second character includes a shading pattern to simulate depth and contour which is unique relative to the first character on the first transfer blanket. The high relief features on the first and second transfer blankets are engageable with the first printing plate and receive a supply of ink therefrom.

The apparatus 1 also includes a can indexer 11. The can indexer is rotationally mounted to the apparatus 1 and has a plurality of stations for receiving cans 8 therein. The can indexer 11 rotationally delivers a plurality of cans 8 sequentially and continuously to a printing site 15 where a first can 8 engages the first blanket and receives ink therefrom at the printing site 15. The can indexer 11 transfers the first can 8 from the printing site 15 while simultaneously transferring a second can 8 to the printing site 15 wherein the second can 8 engages the second blanket and receives ink therefrom.

According to another embodiment of the invention, a method of sequentially and continuously transfers a detailed art to a plurality of beverage cans 8 on a dry rotary offset beverage can printing apparatus 1. A first beverage can 8 in the plurality of beverage cans 8 receives a first detailed art and a second beverage can processed by the apparatus 1 immediately subsequent to the first beverage can 8 receives a second detailed art which is unique relative to the first detailed art.

Low relief features are created on a first non-metallic transfer blanket with a laser having a laser beam spot less than 0.002 inches (0.05 mm) in diameter to remove portions of an upper surface of the first non-metallic transfer blanket in a first pattern. The first transfer blanket also has high relief features comprising non-removed portions of the upper surface. Low relief features are also created on a second non-metallic transfer blanket with the laser to remove portions of an upper surface of the second non-metallic transfer blanket in a second pattern different from the first pattern.

The first and second non-metallic transfer blankets are rotationally mounting on a dry rotary offset printing apparatus.

A plurality of printing plates 3*a*-3*h* are provided and rotationally mounted on the dry rotary offset printing apparatus 1. Each printing plate 3*a*-3*h* has a finished art in high relief. A first printing plate in the plurality of printing plates 3*a*-3*h* has a first finished art comprising a high relief portion of the first printing plate. A second printing plate in the plurality of printing plates has a second finished art in high relief different from the first finished art of the first printing plate.

A first quantity of ink is applied to the high relief portion of the first printing plate. The first printing plate is brought into engagement with the first non-metallic transfer blanket. The first printing plate is rotated against the upper surface of the first non-metallic transfer blanket. Ink is transferred from the high relief portions of the first printing plate to the high relief features of the first non-metallic transfer blanket.

A second quantity of ink is applied to the high relief portion of the second printing plate. The second printing plate is brought into engagement with the first non-metallic transfer blanket. The second printing plate is rotated against the upper surface of the first non-metallic transfer blanket. Ink is transferred from the high relief portions of the second printing plate to the high relief features of the first non-metallic transfer blanket.

A first beverage can is brought into engagement with the first non-metallic transfer blanket. Ink is transferred from the high relief portions of the first non-metallic transfer blanket to form a first art on the first beverage container.

A third quantity of ink is applied to the high relief portion of the first printing plate. The first printing plate is brought into engagement with the second non-metallic transfer blanket. The first printing plate is rotated against the upper surface of the second non-metallic transfer blanket. Ink is transferred from the high relief portions of the first printing plate to the high relief features of the second non-metallic transfer blanket.

A fourth quantity of ink is applied to the high relief portion of the second printing plate. The second printing plate is brought into engagement with the second non-metallic transfer blanket. The second printing plate is rotated against the upper surface of the second non-metallic transfer blanket. Ink is transferred from the high relief portions of the second printing plate to the high relief features of the second non-metallic transfer blanket.

A second beverage can is brought into engagement with the second non-metallic transfer blanket. Ink is transferred from the high relief portions of the second non-metallic transfer blanket to form a second art on the second beverage can. The second art is unique relative to the first art.

A preferred example of embodiment having been described, one should understand that the scope of the present invention embraces other possible variations, being limited only by the contents of the accompanying claims, which include the possible equivalents.

REFERENCE NUMBERS

1: imprinting device
2*a*-2*h*: ink-holders
3*a*-3*h*: printing plates
4*a*-4*h*: plate cylinders
5*a*-5*l*: transfer blankets
6: transfer blanket drum
7: can chain
8: can
9: first directing wheel
10: second directing wheel
11: can carrying device or can indexer
12: central axle
13*a*-13*c*: artwork in low relief
66: an edge portion forming a transition between each of the plurality of low relief features and each of the corresponding high relief features on a transfer blanket
68: an edge portion forming a transition between opposite the edge 66
70: a wall separating the low relief features from the high relief features on a transfer blanket
80: a complex image exhibiting shading
84: an upper surface of a transfer blanket
88: high relief features on a transfer blanket
92: low relief features on a transfer blanket While the specific embodiments have been illustrated and described, numerous modifications come to mind without significantly departing from the spirit of the invention, and the scope of protection is only limited by the scope of the accompanying Claims.

What is claimed is:

1. A can imprinting device for transferring ink to a surface of a beverage can comprising:

a first ink cartridge carrying a first color ink;

a first printing plate comprising a first printing plate surface with a first printing plate finished art in high relief configured to receive the first color ink supplied by the first ink cartridge;

a first transfer blanket comprising a first transfer blanket surface with a first transfer blanket finished art in low relief recessed thereon which is different relative to the first printing plate finished art in high relief;

a second transfer blanket comprising a second transfer blanket surface with a second transfer blanket finished art in low relief recessed thereon which is different relative to the first printing plate finished art in high relief and the first transfer blanket finished art in low relief;

a relative movement between the first printing plate and the first and second transfer blankets bringing the first and second transfer blanket surfaces into engagement with the first printing plate to supply ink from the first printing plate finished art in high relief to the first and second transfer blanket surfaces;

a relative movement between the first transfer blanket and a first can bringing the first transfer blanket surface into contact with the first can to imprint the first can with the first printing plate finished art and the first transfer blanket finished art; and a relative movement between the second transfer blanket and a second can bringing the second transfer blanket surface into contact with the second can to imprint the second can with the first printing plate finished art and the second transfer blanket finished art.

2. The can imprinting device for transferring ink to a surface of a beverage can of claim 1 wherein the first and second transfer blanket finished arts are selected from the group consisting of a name of person, a cartoon, an animal drawing, a country name, a still of a sports activity, a name of a team, and a geometric figure.

3. The can imprinting device for transferring ink to a surface of a beverage can of claim 2 wherein the device transfers ink to a plurality of cans comprising at least the first and second cans continuously without interrupting a production of a plurality of decorated beverage cans produced by the device.

4. The can imprinting device for transferring ink to a surface of a beverage can of claim 3 wherein the first can is imprinted with ink corresponding to the first printing plate finished art and exhibits an absence of ink corresponding to the first transfer blanket finished art, and wherein the second can is imprinted with ink corresponding to the first printing plate finished art and exhibits an absence of ink corresponding to the second transfer blanket finished art.

5. The can imprinting device for transferring ink to a surface of a beverage can of claim 4 wherein each of the first and second transfer blanket surfaces comprise a smooth portion in high relief which engages the first printing plate finished art in high relief and engages the first and second cans under pressure to transfer ink therefrom to the first and second cans, respectively, wherein the first and second transfer blanket low relief finished arts are vertically offset from the smooth portion in high relief such that substantially no ink from the first and second transfer blanket low relief finished arts is transferred to the first and second cans, respectively.

6. The can imprinting device for transferring ink to a surface of a beverage can of claim 1 wherein the device transfers ink to a plurality of cans comprising at least the first and second cans continuously without interrupting a production of a plurality of decorated beverage cans produced by the device.

7. The can imprinting device for transferring ink to a surface of a beverage can of claim 6 wherein the first can is imprinted with ink corresponding to the first printing plate finished art and exhibits an absence of ink corresponding to the first transfer blanket finished art, and wherein the second can is imprinted with ink corresponding to the first printing plate finished art and exhibits an absence of ink corresponding to the second transfer blanket finished art.

8. The can imprinting device for transferring ink to a surface of a beverage can of claim 7 wherein each of the first and second transfer blanket surfaces comprise a smooth portion in high relief which engages the first printing plate finished art in high relief and engages the first and second cans under pressure to transfer ink therefrom to the first and second cans, respectively, wherein the first and second transfer blanket low relief finished arts are vertically offset from the smooth portion in high relief such that substantially no ink from the first and second transfer blanket low relief finished arts is transferred to the first and second cans, respectively.

9. The can imprinting device for transferring ink to a surface of a beverage can of claim 8 wherein the first and second transfer blanket finished arts are selected from the group consisting of a name of person, a cartoon, an animal drawing, a country name, a still of a sports activity, a name of a team, and a geometric figure.

10. The can imprinting device for transferring ink to a surface of a beverage can of claim 1 further comprising:

a rotational plate cylinder wherein the first printing plate is attached thereto and is rotational therewith.

11. The can imprinting device for transferring ink to a surface of a beverage can of claim 10 further comprising:

a rotational drum wherein the first and second transfer blankets are attached thereto and rotational therewith.

12. The can imprinting device for transferring ink to a surface of a beverage can of claim 11 further comprising:

a rotational can carrier wherein the first and second cans are rotationally displaced thereby and wherein the first and second cans are further rotational about respective main axes as the first and second cans are rotationally displaced by the rotational can carrier.

13. The can imprinting device for transferring ink to a surface of a beverage can of claim 1 further comprising:

a second ink cartridge carrying a second color ink;

a second printing plate comprising a second printing plate surface with a second printing plate finished art in high relief configured to receive the second color ink supplied by the second ink cartridge;

a relative movement between the second printing plate and the first and second transfer blankets bringing the first and second transfer blanket surfaces into engagement with the second printing plate to supply ink from the second printing plate finished art in high relief to the first and second transfer blanket surfaces, wherein each of the first and second transfer blanket surfaces receives the first color ink from the first printing plate and the second color ink from the second printing plate.

14. The can imprinting device for transferring ink to a surface of a beverage can of claim 1 wherein the first and second transfer blanket finished arts comprise alphanumeric characters.

15. A can imprinting device for transferring ink to a surface of a beverage can comprising:

a plurality of printing plates, each printing plate attached to a corresponding rotary plate cylinder and having a printing plate finished art in high relief;

a plurality of ink cartridges, each ink cartridge carrying a colored ink, each ink cartridge in the plurality of ink cartridges configured to supply ink to the finished art in high relief of a corresponding printing plate in the plurality of printing plates upon rotation of the corresponding plate cylinder;

a plurality of transfer blankets attached to an outer surface of a rotary transfer blanket drum, each transfer blanket having a transfer blanket surface with a transfer blanket finished art in low relief recessed therein which is different relative to remaining transfer blankets in the plurality of transfer blankets;

the rotary transfer blanket drum configured to bring each transfer blanket in the plurality of transfer blankets into contact with each printing plate in the plurality of printing plates to transfer ink from each printing plate finished art in high relief to the transfer blanket surface of each transfer blanket in the plurality of transfer blankets;

a can carrier which delivers each can in a plurality of cans to one of the transfer blankets where rotation of each can against one of the transfer blankets imprints each can with ink corresponding to the finished art in high relief from each printing plate and with the transfer blanket finished art from one of the transfer blankets.

16. The can imprinting device for transferring ink to a surface of a beverage can of claim 15 wherein each transfer blanket finished art is selected from the group consisting of a name of a person, a name of a team, and a geometric figure.

17. The can imprinting device for transferring ink to a surface of a beverage can of claim 15 wherein the device transfers ink to the plurality of cans continuously without interrupting a production of a plurality of decorated beverage cans produced by the device.

18. The can imprinting device for transferring ink to a surface of a beverage can of claim 15 wherein subsequent to processing, each can in the plurality of cans comprises a portion in an original color of the can prior to decoration which corresponds to the transfer blanket finished art on a corresponding transfer blanket which engages the can during operation.

19. The can imprinting device for transferring ink to a surface of a beverage can of claim 15 wherein each transfer blanket surface further comprises a smooth portion in high relief relative to the transfer blanket finished art in low relief.

20. An improvement to a rotary dry offset beverage can imprinting device which continuously without interruption transfers a plurality of ink patterns from a smooth surface in high relief of a single transfer blanket in a plurality of transfer blankets, where each ink pattern in the plurality of ink patterns corresponds to a printing plate finished art in high relief on one of a plurality of printing plates, to each beverage can in a production sequence comprising a plurality of beverage cans, the improvement comprising:

a first transfer blanket finished art in low relief on the smooth surface of a first transfer blanket in the plurality of transfer blankets, and a second transfer blanket finished art in low relief on a second transfer blanket in the plurality of transfer blankets, the first transfer blanket finished art being different from the second transfer blanket finished art such that consecutively decorated first and second beverage cans in the production sequence exhibit an identical art corresponding to the printing plate finished arts and a different finished art corresponding to only one of the first or second transfer blanket finished arts in low relief.

* * * * *